US009997068B2

(12) United States Patent
Breed

(10) Patent No.: US 9,997,068 B2
(45) Date of Patent: Jun. 12, 2018

(54) METHOD FOR CONVEYING DRIVING CONDITIONS FOR VEHICULAR CONTROL

(71) Applicant: Intelligent Technologies International, Inc., Miami Beach, FL (US)

(72) Inventor: David S Breed, Miami Beach, FL (US)

(73) Assignee: Intelligent Technologies International, Inc., Miami Beach, FL (US)

( * ) Notice: Subject to any disclaimer, the term of this patent is extended or adjusted under 35 U.S.C. 154(b) by 0 days. days.

(21) Appl. No.: 15/594,954

(22) Filed: May 15, 2017

(65) Prior Publication Data

US 2017/0249838 A1 Aug. 31, 2017

Related U.S. Application Data

(60) Continuation-in-part of application No. 14/658,568, filed on Mar. 16, 2015, now Pat. No. 9,652,984, (Continued)

(51) Int. Cl.
*G08G 1/09* (2006.01)
*G08G 1/0967* (2006.01)
(Continued)

(52) U.S. Cl.
CPC ..... *G08G 1/096716* (2013.01); *G07C 5/008* (2013.01); *G07C 5/085* (2013.01); *G08G 1/096758* (2013.01); *G08G 1/096783* (2013.01)

(58) Field of Classification Search
CPC ..... G08G 1/096716; G08G 1/096758; G08G 1/096783; G07C 5/008; G07C 5/085
See application file for complete search history.

(56) References Cited

U.S. PATENT DOCUMENTS 4,690,553 A 9/1987 Fukamizu et al.
4,897,642 A 1/1990 DiLullo et al.
(Continued)

FOREIGN PATENT DOCUMENTS

DE 3636258 A1 4/1988
DE 3911916 A1 5/1990
(Continued)

OTHER PUBLICATIONS

Abstract of DE 3636258 dated Apr. 28, 1988.
(Continued)

*Primary Examiner* — Adam D Tissot
(74) *Attorney, Agent, or Firm* — Brian Roffe

(57) ABSTRACT

Method for conveying driving conditions and using the conveyed driving conditions for vehicular control includes generating information about a travel surface or an environment around the travel surface using sensors fixed in position relative to the travel surface. Each sensor includes a measuring or detecting component that measures or detects a property or condition of the travel surface or the environment around the travel surface. A communication of the information generated by that sensor to a vehicle or its occupant is initiated only when that vehicle is within the set distance from a sensor. Operation of a display, navigation, control and/or guidance system in that vehicle is caused to change from an existing operating state to one of several different operating states as a result of reception of the communication from the sensor.

20 Claims, 12 Drawing Sheets

Related U.S. Application Data which is a division of application No. 14/275,003, filed on May 12, 2014, now Pat. No. 8,989,920, which is a continuation-in-part of application No. 14/026,513, filed on Sep. 13, 2013, now Pat. No. 8,781,715, which is a division of application No. 12/020,684, filed on Jan. 28, 2008, now Pat. No. 9,014,953, said application No. 14/275,003 is a continuation-in-part of application No. 12/020,684, filed on Jan. 28, 2008, now Pat. No. 9,014,953.

(51) Int. Cl.
*G07C 5/00* (2006.01)
*G07C 5/08* (2006.01)

(56) References Cited

U.S. PATENT DOCUMENTS

| | | | | |
|---|---|---|---|---|
| 4,926,163 | A | 5/1990 | Beebe | |
| 5,111,400 | A | 5/1992 | Yoder | |
| 5,157,610 | A | 10/1992 | Asano | |
| 5,218,343 | A | 6/1993 | Stobbe et al. | |
| 5,223,844 | A | 6/1993 | Mansell et al. | |
| 5,289,183 | A | 2/1994 | Hassett et al. | |
| 5,311,197 | A | 5/1994 | Sorden et al. | |
| 5,334,974 | A | 8/1994 | Simms | |
| 5,365,516 | A | 11/1994 | Jandrell | |
| 5,381,338 | A | 1/1995 | Wysocki et al. | |
| 5,420,580 | A | 5/1995 | Rawls | |
| 5,424,727 | A | 6/1995 | Shieh | |
| 5,493,291 | A | 2/1996 | Bruggemann | |
| 5,548,515 | A | 8/1996 | Pilley et al. | |
| 5,561,610 | A | 10/1996 | Schricker et al. | |
| 5,646,612 | A | 7/1997 | Byon | |
| 5,663,548 | A | 9/1997 | Hayashi et al. | |
| 5,673,039 | A * | 9/1997 | Pietzsch | G08G 1/015 340/332 |
| 5,699,056 | A | 12/1997 | Yoshida | |
| 5,801,647 | A | 9/1998 | Survo et al. | |
| 5,847,661 | A | 12/1998 | Ricci | |
| 5,847,663 | A | 12/1998 | Chasek | |
| 5,852,243 | A | 12/1998 | Chang et al. | |
| 5,900,825 | A | 5/1999 | Pressel et al. | |
| 5,939,987 | A | 8/1999 | Cram | |
| 5,942,993 | A | 8/1999 | Mio et al. | |
| 5,974,368 | A | 10/1999 | Schepps et al. | |
| 6,140,941 | A * | 10/2000 | Dwyer | G07B 15/063 235/384 |
| 6,161,071 | A | 12/2000 | Shuman et al. | |
| 6,281,806 | B1 | 8/2001 | Smith | |
| 6,301,544 | B1 | 10/2001 | Sondregger | |
| 6,345,228 | B1 | 2/2002 | Lees | |
| 6,405,132 | B1 | 6/2002 | Breed et al. | |
| 6,441,748 | B1 | 8/2002 | Takagi et al. | |
| 6,487,500 | B2 * | 11/2002 | Lemelson | G01S 19/11 340/436 |
| 6,758,089 | B2 | 7/2004 | Breed et al. | |
| 6,940,424 | B2 | 9/2005 | Philiben et al. | |
| 7,295,925 | B2 | 11/2007 | Breed et al. | |
| 7,605,720 | B1 | 10/2009 | Menzie, Jr. et al. | |
| 8,142,100 | B2 | 3/2012 | Hanson | |
| 8,180,547 | B2 | 5/2012 | Prasad et al. | |
| 8,410,941 | B2 | 4/2013 | Kelly et al. | |
| 8,717,193 | B2 | 5/2014 | Velusamy | |
| 8,766,816 | B2 | 7/2014 | Takatsudo et al. | |
| 9,014,953 | B2 | 4/2015 | Breed et al. | |
| 2002/0145519 | A1 | 10/2002 | Hykawy | |
| 2002/0175829 | A1 * | 11/2002 | Dunagin | G08G 1/096716 340/905 |
| 2008/0119966 | A1 | 5/2008 | Breed et al. | |
| 2008/0186205 | A1 | 8/2008 | Breed et al. | |
| 2014/0002253 | A1 | 1/2014 | Yilmaz et al. | |
| 2014/0266655 | A1 | 9/2014 | Palan | |
| 2015/0070164 | A1 | 3/2015 | Schalk et al. | |

FOREIGN PATENT DOCUMENTS

| | | | |
|---|---|---|---|
| DE | 4003410 | C2 | 8/1991 |
| DE | 10203891 | A1 | 8/2003 |
| EP | 0521846 | A1 | 1/1993 |
| GB | 2427058 | A | 12/2006 |
| JP | H01-197145 | A | 12/1993 |

OTHER PUBLICATIONS

Abstract of DE 3911916 dated May 10, 1990.
Abstract of EP 0521846 dated Jan. 7, 1993.
McKeown Jr., David M., Cooperative Methods for Road Tracking in Aerial Imagery, The Computer Society Conference of Computer Vision and Pattern Recognition, Jun. 5-9, 1988, pp. 662-672.
Diesel Locomotive Reliability Improvements by System Monitoring, 209 Proc. Inst. of Mechanical Engineers, Part F: J. of Rail & Rapid Transit 1 (Jan. 1995).
Roadside Systems Detect Wildlife to Prevent Collisions, by Colin Wood, Aug. 27, 2013, retrieved from http://www.govtech.com/public-safety/Roadside-Systems-Detect-Wildlife-to-Prevent-Collisions.html.
Animals and Vehicle Collision Avoidance Using Wireless Sensor Actuator Network, by Prof. Latha Venkatesan, S. Omar Farooq, J.Faisal Imraan, K.Jegan Kumar, J.Naveen Kumar, International Journal of Scientific & Engineering Research, vol. 4, Issue 5, May-2013, pp. 1856-1858.
Reducing Roadkill, by Brittany Sauser on Oct. 5, 2006, retrieved from http://www.technologyreview.com/news/406630/reducing-roadkill/.
A Literature Review for Assessing the Status of Current Methods of Reducing Deer-Vehicle Collisions by Dr. Brent J. Danielson and Dr. Michael W. Hubbard, a report prepared for The Task Force on Animal Vehicle Collisions, The Iowa Department of Transportation, and The Iowa Department of Natural Resources, submitted Sep. 1998.
Animal-Vehicle Crash Mitigation Using Advanced Technology Phase II: System Effectiveness and System Acceptance, Final Report by Marcel P. Huijser, PhD, Research Ecologist, et al., Mar. 2009.

* cited by examiner

FIG. 2
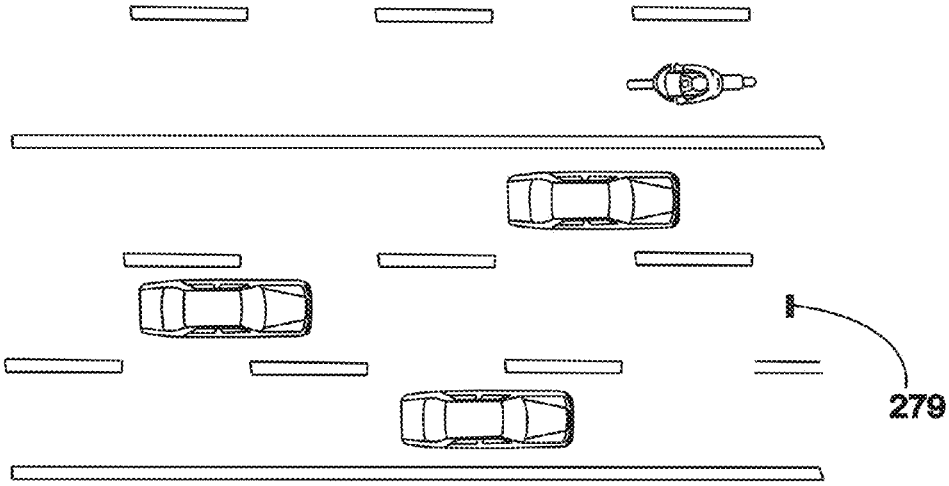
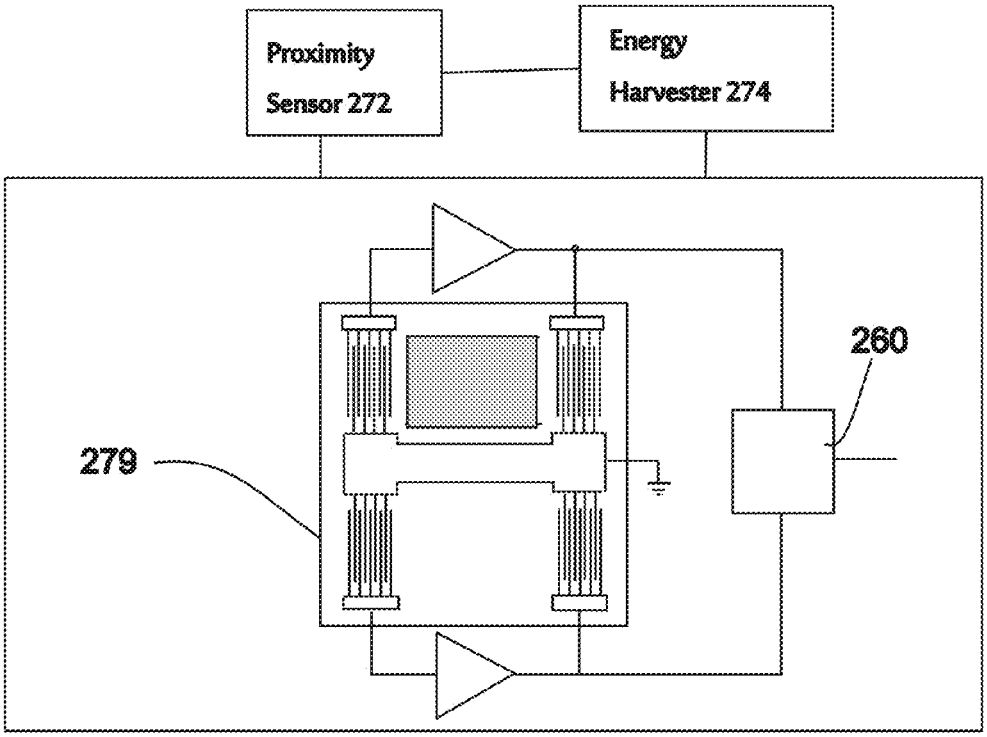
FIG. 2A

FIG. 8A
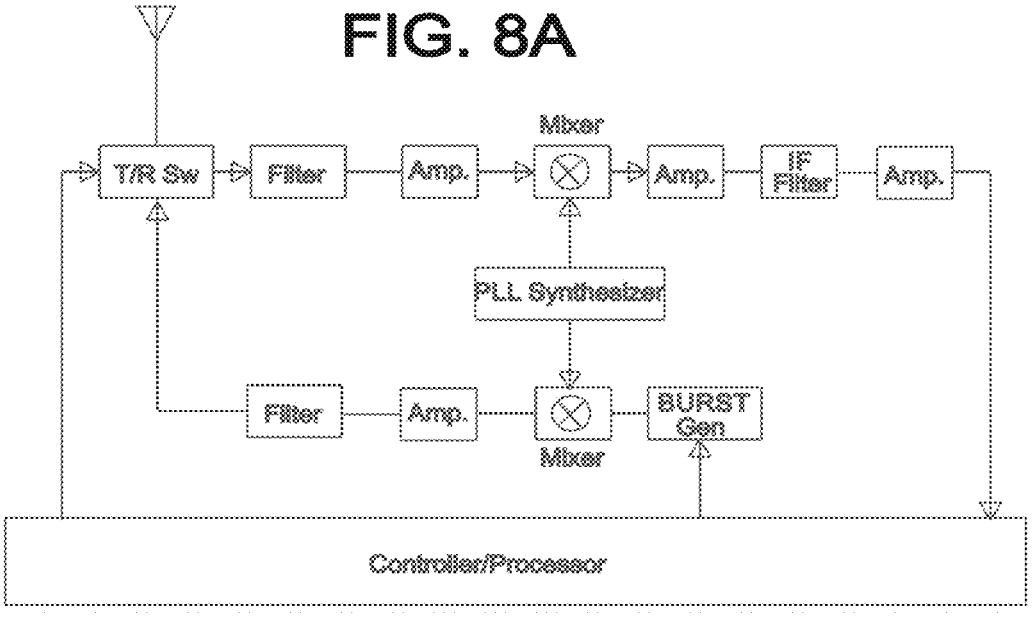
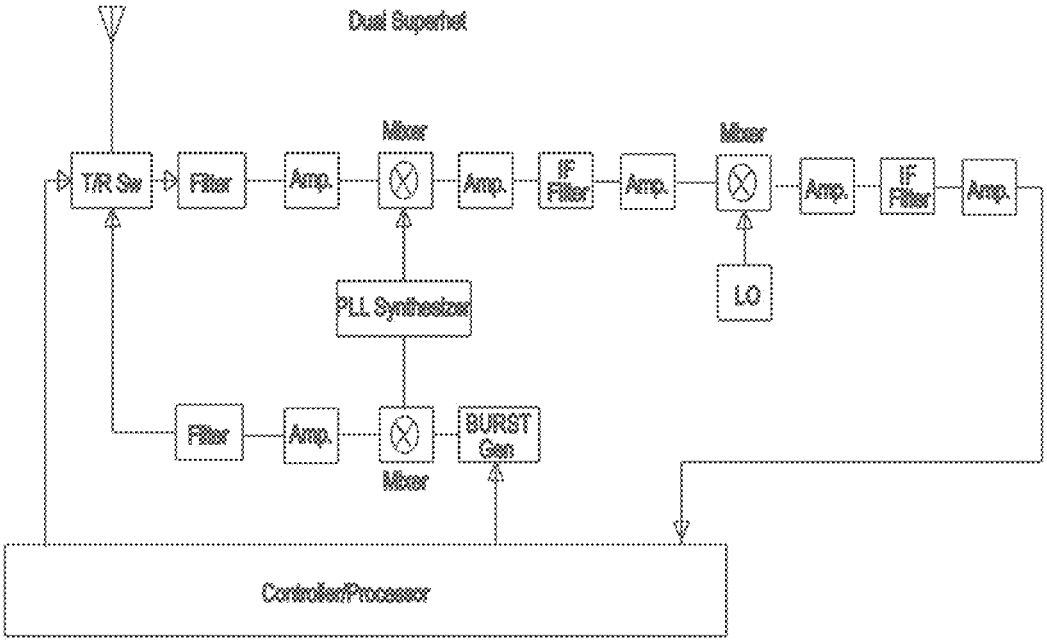
FIG. 8B

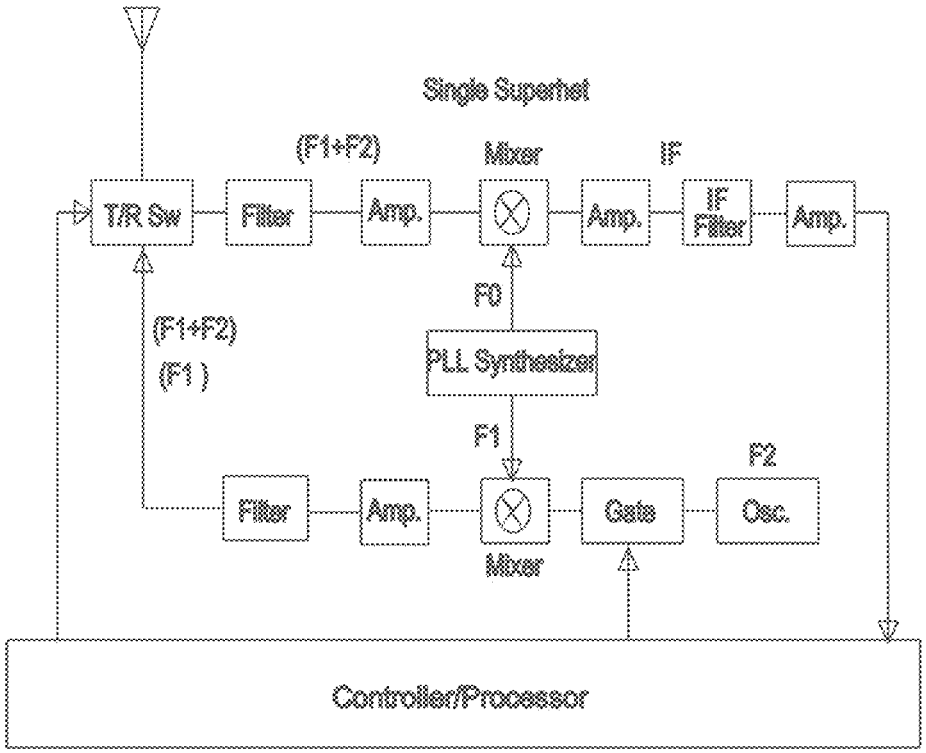
FIG. 8C
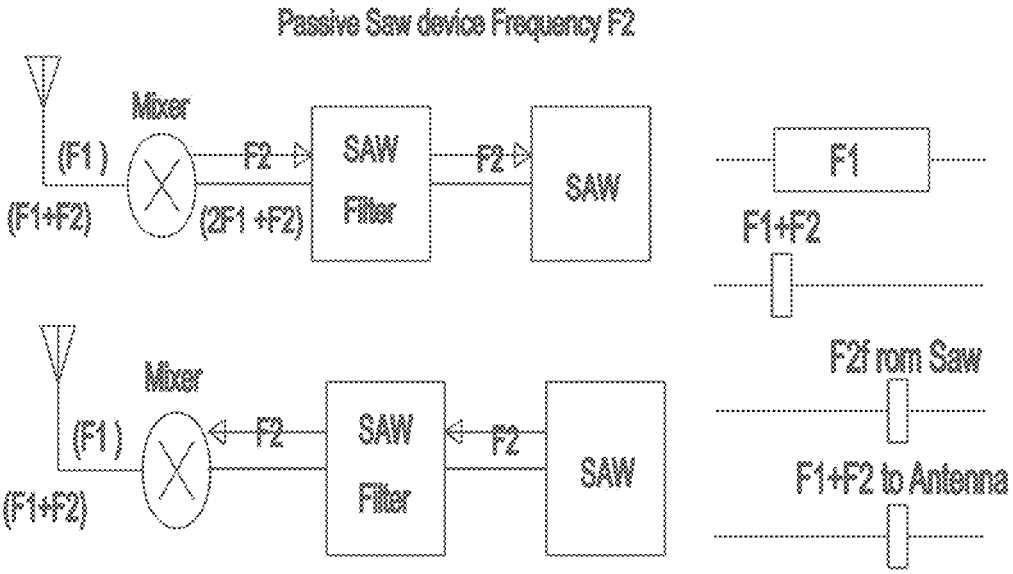

METHOD FOR CONVEYING DRIVING CONDITIONS FOR VEHICULAR CONTROL

CROSS REFERENCE TO RELATED APPLICATIONS

This application is a continuation-in-part of U.S. patent application Ser. No. 14/658,568 filed Mar. 16, 2015, which is a divisional of U.S. patent application Ser. No. 14/275,003 filed May 12, 2014, now U.S. Pat. No. 8,989,920, which is:

1. a continuation-in-part (CIP) of U.S. patent application Ser. No. 12/020,684 filed Jan. 28, 2008, now U.S. Pat. No. 9,014,953, and 2. a CIP of U.S. patent application Ser. No. 14/026,513 filed Sep. 13, 2013, now U.S. Pat. No. 8,781,715, which is a divisional of U.S. patent application Ser. No. 12/020,684 filed Jan. 28, 2008, now U.S. Pat. No. 9,014,953.

This application is related to U.S. patent application Ser. No. 09/679,317 filed Oct. 4, 2000, now U.S. Pat. No. 6,405,132, Ser. No. 09/765,558 filed Jan. 19, 2001, now U.S. Pat. No. 6,748,797, Ser. No. 09/909,466 filed Jul. 19, 2001, now U.S. Pat. No. 6,526,352, Ser. No. 10/079,065 filed Feb. 19, 2002, now U.S. Pat. No. 6,662,642, Ser. No. 10/188,673 filed Jul. 3, 2002, now U.S. Pat. No. 6,738,697, Ser. No. 10/190,805 filed Jul. 8, 2002, now U.S. Pat. No. 6,758,089, Ser. No. 10/216,633 filed Aug. 9, 2002, now U.S. Pat. No. 6,768,944, Ser. No. 10/613,453 filed Jul. 3, 2003, now U.S. Pat. No. 6,850,824, Ser. No. 10/701,361, filed Nov. 4, 2003 now U.S. Pat. No. 6,988,026, Ser. No. 10/822,445 filed Apr. 12, 2004, now U.S. Pat. No. 7,085,637, Ser. No. 10/940,881 filed Sep. 13, 2004, now U.S. Pat. No. 7,663,502, Ser. No. 11/028,386 filed Jan. 3, 2005, now U.S. Pat. No. 7,110,880, Ser. No. 11/034,325 filed Jan. 12, 2005, now U.S. Pat. No. 7,202,776, Ser. No. 11/082,739 filed Mar. 17, 2005, now U.S. Pat. No. 7,421,321, Ser. No. 11/562,730 filed Nov. 22, 2006, now U.S. Pat. No. 7,295,925, Ser. No. 12/062,099 filed Apr. 3, 2008, now abandoned, and Ser. No. 14/595,504 filed Jan. 13, 2015, now U.S. Pat. No. 9,558,663, and U.S. provisional patent application Ser. No. 60/231,378 filed Sep. 8, 2000, Ser. No. 60/269,415 filed Feb. 16, 2001, Ser. No. 60/291,511 filed May 16, 2001, and Ser. No. 60/304,013 filed Jul. 9, 2001, on the grounds that they include common subject matter.

All of the references, patents and patent applications that are mentioned herein and in the parent applications are incorporated by reference in their entirety as if they had each been set forth herein in full.

FIELD OF THE INVENTION

The present invention relates generally to the field of sensing conditions of a roadway, or other travel surface, and the environment surrounding the roadway and conveying this information for use by vehicles or an occupant thereof travelling on the roadway. More specifically, the present invention relates to methods for conveying driving conditions and using the conveyed driving conditions for vehicular control.

BACKGROUND OF THE INVENTION

This invention is related to use of sensors arranged in fixed locations in conjunction with roadways, e.g., embedded in the roadway or ancillary structures, to enable information about the roadway and its environment to be obtained from the presence of these sensors and the information provided by the sensors to be considered in the operation of the vehicle and in the actions to be undertaken to alter the conditions of the roadway, if appropriate.

Additional and detailed background of the invention is set forth in the patents issued from the parent applications, namely U.S. Pat. No. 6,662,642, as well as U.S. Pat. No. 6,758,089.

SUMMARY OF THE INVENTION

A method for conveying driving conditions and using the conveyed driving conditions for vehicular control in accordance with the invention includes generating information about a travel surface or an environment around the travel surface using sensors fixed in position relative to the travel surface. Each sensor includes a measuring or detecting component that measures or detects a property or condition of the travel surface or the environment around the travel surface that affects interaction between tires and the travel surface and which is part of the generated information. Only when a vehicle is within the set distance from the one of the sensors, a communication of the information generated by the one of the sensors to the vehicle within the set distance from the sensor or occupant thereof is initiated, whereby a communication of the information generated by each sensor is not initiated unless a vehicle is within the set distance from that sensor. Operation of a display, navigation, control and/or guidance system in the vehicle within the set distance from the one of the sensors is caused to change from an existing operating state to one of a plurality of different operating states as a result of reception of the communication from the one of the sensors. The specific one of the different operating states to which the display, navigation, control or guidance system is changed is determined based on the communication.

For example, a visual indication of content of the communication may be displayed on a map shown on the display such that the visual indication of the content of the communication is placed on the map as the vehicle approaches the position of the one of the sensors. To aid this, each sensor is configured to include an identification code indicative of its position with the communication. The control and/or guidance system may be caused to enter into an operating state in which each system changes movement of the vehicle from its course prior to reception of the sensor-generated information to a new course dependent on the communication. The navigation system may be caused to enter into an operating state in which it generates a warning dependent on the communication.

The sensors may be coupled to a telecommunications and data network, in which case, the communication of the information generated by the one of the sensors, initiated only when a vehicle is within the set distance from the one of the sensors, is transmitted to the vehicle using the telecommunications and data network, e.g., the Internet and associated transmission schemes such as WiFi. Additionally or alternatively, the communication of the information generated by each sensor may be received at a remote location, a determination made when a vehicle on the travel surface is within the set distance from each sensor (using a proximity sensor for example), and the information generated by each sensor transmitted to the vehicle using the telecommunications and data network only when the vehicle on the travel surface is determined to be within the set distance from each sensor. Determining when a vehicle on the travel surface is within the set distance from each sensor may entail analyzing position of the vehicle relative to the fixed position of each sensor to determine if the positional difference is less than the set distance.

In one embodiment, the sensors are coupled to a dedicated short range communications network, in which case, the communication of the information generated by the one of the sensors, initiated only when a vehicle is within the set distance from the one of the sensors, is transmitted to the vehicle using the dedicated short range communications (DSRC) network.

The communication initiated using the communication system associated with each of the sensor may be a wireless transmission intended for reception by a vehicular navigation system, whereby operation of the navigation system is changed from the existing operating state to one of the plurality of different operating states as a result of reception of the wireless transmission.

In some, but not all, embodiments, a proximity sensor coupled to each sensor, or multiple sensors, may be used to determine when a vehicle on the travel surface is within the set distance from each sensor. The proximity sensor may use one or more of a thermal system, a sound sensing system, an optic system, radar or laser radar (lidar) to analyze proximity of a vehicle to the respective sensor. In one embodiment, the proximity sensor includes a camera or other optical sensor that obtains images, so that determining when the vehicle on the travel surface is within the set distance from each sensor involves analyzing images obtained by the camera or other optical sensor to assess a distance between the sensor and the vehicle.

As to non-limiting examples of sensor positioning, sensors may be located in a stationary mounting structure in a vicinity of the travel surface and apart from the travel surface or embedded in the travel surface. Regardless of the location, each sensor may be configured to generate information about travel conditions relating to the travel surface or external objects on or in the vicinity of the travel surface that potentially affect travel of vehicles on the travel surface. The property or condition of the travel surface or the environment around the travel surface being measured or detected by the measuring or detecting component in each sensor can be friction of the travel surface, atmospheric pressure, atmospheric temperature, temperature of the travel surface, moisture content of the travel surface or humidity of the atmosphere.

Energy may be provided to each sensor from an energy harvesting system included in or connected to the sensor and that generates energy and provides the generated energy to the measuring or detecting component to enable the measuring or detecting component to measure or detect the property or condition of the travel surface or the environment around the travel surface.

A related method for controlling a display system to provide specific information about driving conditions on a travel surface includes generating driving condition specific information using sensors fixed in position relative to the travel surface, such as described above, only when a vehicle is within the set distance from the one of the sensors, initiating a communication of the information generated by the one of the sensors to the vehicle determined to be within the set distance from the sensor or occupant thereof, and causing the display system in the vehicle within the set distance from the one of the sensors to display a visual indication of content of the communication on a map shown on the display such that the visual indication of the content of the communication is placed on the map as the vehicle approaches the position of the one of the sensors. The same features of the method described above may be included in this method as well.

The applicant intends that everything disclosed herein can, but is not required to be, be used in combination on a single vehicle or structure.

BRIEF DESCRIPTION OF THE DRAWINGS

The following drawings are illustrative of embodiments of the invention and are not meant to limit the scope of the invention as encompassed by the claims.

FIG. 2 is an overhead view of a roadway with vehicles and a SAW road temperature and humidity monitoring sensor.

FIG. 2A is a detail drawing of the monitoring sensor of FIG. 2.

FIGS. 8A, 8B and 8C are block diagrams of three interrogators that can be used with this invention to interrogate several different devices.

DETAILED DESCRIPTION OF PREFERRED EMBODIMENTS

Figure 1:
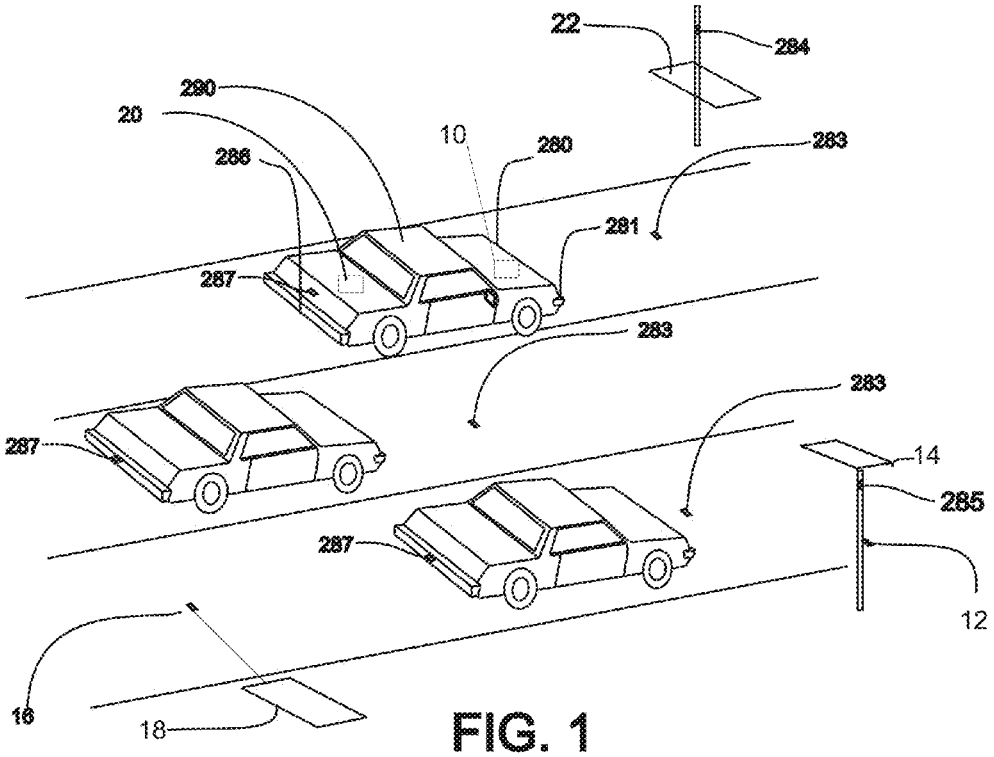
FIG. 1 is a perspective view of a SAW system for locating a vehicle on a roadway, and on the earth surface if accurate maps are available, and also illustrates the use of a SAW transponder in the license plate for the location of preceding vehicles and preventing rear end impacts.

There are many instances where a properly placed sensor on or near a roadway which communicates with vehicles on the roadway could sense potentially dangerous situations and warn the vehicle driver. The installation of such sensor and warning systems frequently require power in the form of a connection to the electric grid to operate. In many locations, this grid connection is not available. In many other situations, it is available but requires expensive installation and wiring. What is needed, therefore, is a sensor and communication system which senses a potentially dangerous situation and warns the drivers of approaching vehicles but does not require connection to the grid. In many situations, solar energy harvesting could provide the power for such a system but if it is operating continuously, then sufficient power in many cases cannot be provided by a small solar collector. This is especially a problem when consideration is given to the requirement that this device must operate 24 hours per day. Thus, the solar collector must be used to charge batteries and the energy consumed by the sensor and communication system must not exceed the capacity of the batteries. One way of solving this problem is to substantially reduce the duty cycle of the sensor and communication system. If, for example, the communication system only operates when there is a vehicle in the vicinity that could make use of the sensor information than the power requirements can be substantially reduced.

There are many ways in which the sensor and communication system can communicate with a passing vehicle. A radio frequency signal can be transmitted by the sensing system, however, this requires that all passing vehicles be equipped with apparatus capable of receiving and displaying or otherwise communicating the information to the driver. Since most vehicles will not have such a system, an alternative is for the communication to be accomplished visually. One method is for the communication system to make use of a sign which informs the driver of the potential hazard. This sign could only be illuminated when the hazard is present and there is an approaching vehicle.

For example, if the sensor system has detected that black ice exists on the roadway, then a sign saying black ice can be displayed in the field of view of the approaching vehicle. Since it would require energy to maintain this display, the display would only be activated, or illuminated, when a vehicle is known to be present. Therefore, the vehicle presence needs to be sensed by the sensor and communication system which can be done using very low power in a variety of manners. For example, an infrared camera or sensor which monitors the roadway near the sign can detect that a vehicle having an elevated temperature is approaching and then the sign can be activated. Radar systems exist now which use very low power and once again, this radar can monitor the roadway approaching the sign and detect an approaching vehicle.

Other systems include optical, such as a camera, or ultrasonic sensor systems which also can determine the presence of an approaching vehicle. During the daytime, light reflected off the vehicle would be sufficient to detect an approaching vehicle by its motion, for example. Similarly, ultrasound operating in a manner similar to radar can detect the approach of a vehicle. Apparatus exists using any of these technologies which require very low power and permit the vehicle to communicate its presence to the sign system.

A sensor for sensing black ice can be embedded in the roadway using SAW technology as described below which can periodically respond to an interrogator signal from the sensor and communication system. Similarly, monitoring the temperature and the humidity coupled with historical patterns will permit the sensor and communication system to determine that black ice is probable and thus provide such a warning. If the SAW device is passive, then the interrogator must be close to the device. If power is available, then transmission distance can be significantly increased.

There are hundreds of thousands of impacts with large animals, such as deer and elk, by vehicles traveling the roadways in the United States each year. If vehicle drivers could be informed of the presence of such an animal in the vicinity, he or she could be warned to drive cautiously and thereby avoid such an accident. The sensor and communication system can be provided with sensors which detect the presence of such animals. Such sensors can comprise microphones which listen for characteristic animal sounds, infrared sensors which are sensitive to the body temperatures of such animals, and optical and ultrasonic sensors which detect the motion, for example, that would be characteristic of a large animal. These sensor and communication systems can be appropriately placed in areas where animal impacts are common and again when a vehicle approaches a sign, can be illuminated, or a light can be made to flash, warning the driver of the presence of animals.

Many pedestrians are killed or injured as they cross roadways unseen by approaching motorists. The presence of a pedestrian in a crosswalk can similarly be sensed in a similar manner as animals near roadways, as discussed above. Once again, when such a pedestrian is detected a warning sign or light can be provided to warn approaching motorists of the potential danger.

Each of these systems described above use sufficiently low energy that reasonably sized solar panels can provide that energy. Thus, installations of such systems can be very inexpensive and thus can be placed in many areas reducing vehicle accidents. Another low power system employs a passive sign which is visible at all times coupled with a flashing light. The sign says that, for example, "Caution, deer are present in the area when the light is flashing". The flashing light can be accomplished using low-power LEDs with a low duty cycle thereby conserving energy. The light can be directed so that it is most easily seen by oncoming vehicles. The power usage of such LEDs is sufficiently low that they can probably be left in a flashing mode whenever animals, for example, are present without exhausting the stored energy. If available power is still a concern, then the LEDs can be turned on only when vehicles are approaching, in which case they can also be made much brighter.

Referring now to the drawings wherein the same reference numerals refer to the same or similar elements, as shown in FIG. 1, if a SAW device 283 is placed in a roadway, possibly embedded in the roadway or arranged in a housing embedded or attached to the roadway, and if a vehicle 290 has one or more receiving antennas 280 and 281, an interrogator 10 on the vehicle (not shown in FIG. 1) can transmit a signal from either of the two antennas and at a later time, the two antennas 280, 281 will receive the transmitted signal from the SAW device 283. By comparing the arrival time of the two received pulses at the antennas 280, 281, the position of a vehicle 290 on a lane can be precisely determined (since the direction from each antenna 280, 281 to the SAW device 283 can be calculated).

The connections between the interrogator 10 and the two antennas 280, 281 are not shown but may be a wired or wireless connection. The interrogator 10 may be powered by the vehicle battery and/or other energy generating and/or storage system on the vehicle 290.

If the SAW device 283 has an identification (ID) code encoded into the returned signal generated thereby, then the vehicle 290 can determine, providing a precise map is available, its position on the surface of the earth. One skilled in the art would understand the manner in which an ID code may be integrated into a return signal being provided by a SAW device. If another antenna 286 is provided on the vehicle, for example, at the rear of the vehicle 290, then the longitudinal position of the vehicle 290 can also be accurately determined as the vehicle 290 passes the SAW device 283. The connection between the interrogator 10 and the antenna 2856 is also not shown but may be a wired or wireless connection. Antenna 286 receives a return signal from the SAW device 283 after the interrogator 10 transmits its activation signal.

The SAW device 283 is shown in one lane of a multi-lane roadway but this is an example only and the SAW device 283 may be arranged on any surface on which a land vehicle travels. Of course, the SAW device 283 need not be in the center of the road. Alternate locations for positioning of the SAW device 283 are on overpasses above the road and on poles such as 284 and 285 on the roadside. Poles 284, 285 represent any stationary structure situated proximate, along or on a roadway or other travel surface.

However, if the SAW or other sensing device is not within about a meter from the interrogator 10 on the vehicle, then power must typically be supplied. Thus, if the sensing device 12 is on a roadside structure such as 284 or 285, then a source of power must be supplied which can be in the form of solar-generated electricity and a storage battery, represented by solar panel 14 on the pole 285. Such a system has an advantage over a competing system using radar and reflectors in that it is easier to measure the relative time between the two received pulses than it is to measure time of flight of a radar signal to a reflector and back. Such a system operates in all weather conditions and is known as a precise location system.

Eventually, such a SAW device 283 (or 12) can be placed every tenth of a mile along the roadway or at some other appropriate spacing. Although SAW devices are discussed here, any comparable sensing system can be utilized.

An additional or alternate use of this system is to provide a roadway-based sensor 16 with the capability of determining the presence of black ice on the roadway. This sensor 16 can be provided with a communications unit to enable it to communicate directly with the sensor on a pole 284, 285 adjacent the highway, in which case power must be supplied to the sensor 16 which again can be in the form of a solar collector embedded in the roadway, e.g., solar panel 18 connected to the sensor 16.

Figure 9:
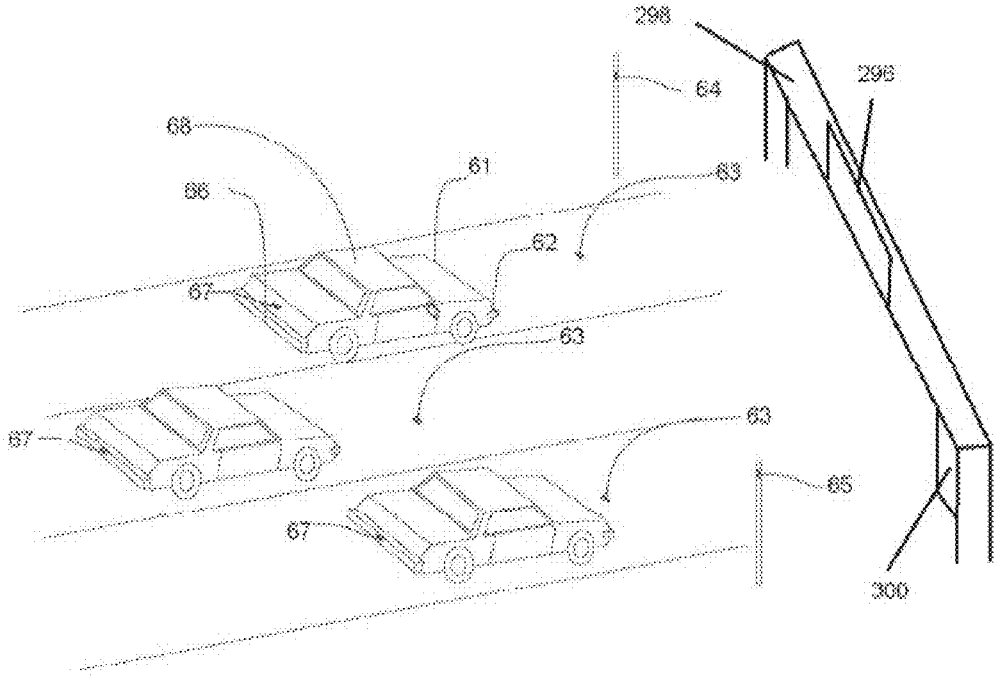
FIG. 9 is a schematic showing an alternate visual and audio notification of, for example, road surface conditions or animal presence, to vehicles.

Alternatively, as the vehicle 290 passes over the sensor 16, 283, it can detect from this sensor 283 that black ice is present and the vehicle 290 can communicate, using an on-board communications system 20, that information to the sensor 12 on the pole 285. An electronic sign 22 can be mounted on the pole 284 such that a warning is displayed visible to the driver of the vehicle 290 and other approaching vehicles that black ice is present at the location of the pole 285 (such a sign may also be mounted on pole or another structure proximate or along the roadway, as shown in FIG. 9).

Additionally or alternatively, if the vehicle 290 or pole 284 is directly or indirectly connected to the Internet, this information that black ice is present can be made available through the Internet to vehicles approaching this area from a greater distance.

As noted in U.S. Pat. No. 6,405,132, in some locations where weather conditions can deteriorate and degrade road surface conditions, various infrastructure-based sensors, of which SAW sensors 283 are examples, can be placed either in or adjacent to the road surface. As described therein, a subsystem is provided on the vehicle and designed to interrogate and obtained information from such road-based systems. An example of such a road-based system would be an RFID tag containing a temperature sensor, e.g., a SAW temperature sensor. This device may be battery-powered or, preferably, would receive its power from energy harvesting (e.g., solar energy, vibratory energy), the vehicle-mounted interrogator, or other host vehicle-mounted source, as the vehicle passes nearby the device. In this manner, the vehicle can obtain the temperature of the road surface and receive advanced warning when the temperature is approaching conditions which could cause icing of the roadway, for example. An RFID based on a surface acoustic wave (SAW) device is one preferred example of such a sensor, see U.S. Pat. No. 6,662,642. An infrared sensor on the vehicle can also be used to determine the road temperature and, along with a humidity sensor, the existence of ice or snow surmised.

In one embodiment, SAW devices 283, in any arrangement shown for example in FIG. 1, are provided with a proximity sensor to sense the presence of a vehicle 290 (see the description of FIG. 2A below). In this case, when the proximity sensor determines that a vehicle is approaching, it can perform a measurement of, for example, the temperature of the roadway, and transmit that information to the vehicle 290 or to a roadside sensor and communication system, mounted for example on one or both poles 284, 285. The measurement may be performed by the SAW device only after the presence of a vehicle within a set distance from the proximity sensor is detected or continuously. In the latter case, the SAW device 283 could obtain a measurement of the temperature of the roadway in advance of receiving a signal from the vehicle-mounted interrogator and then when it receives the signal from the vehicle-mounted interrogator, i.e., when it is activated, it would have temperature data readily available for communication directly to the vehicle or occupant in one of the ways described herein, e.g., without an intermediary or intervening structural component.

If a vehicle is being guided by a DGPS and accurate map system such as disclosed in U.S. patent application Ser. No. 09/679,317, now U.S. Pat. No. 6,405,132, a problem arises when the GPS receiver system loses satellite lock as would happen when the vehicle 290 enters a tunnel, for example. If a precise location system as described above is placed at the exit of the tunnel, then the vehicle 290 will know exactly where it is and can re-establish satellite lock in as little as one second rather than typically 15 seconds as might otherwise be required. Other methods making use of the cell phone system can be used to establish an approximate location of the vehicle suitable for rapid acquisition of satellite lock as described in G. M. Djuknic, R. E. Richton "Geolocation and Assisted GPS", Computer Magazine, February 2001, IEEE Computer Society, which is incorporated by reference herein in its entirety.

Additionally or alternatively, if the vehicle has an onboard inertial measurement unit (IMU), it can know its accurate position as it leaves the tunnel, or, it will know when it leaves the tunnel and can get its accurate position from a digital map.

More particularly, geolocation technologies that rely exclusively on wireless networks such as time of arrival, time difference of arrival, angle of arrival, timing advance, and multipath fingerprinting offer a shorter time-to-first-fix (TTFF) than GPS. They also offer quick deployment and continuous tracking capability for navigation applications, without the added complexity and cost of upgrading or replacing any existing GPS receiver in vehicles. Compared to either mobile-station-based, stand-alone GPS or network-based geolocation, assisted-GPS (AGPS) technology offers superior accuracy, availability, and coverage at a reasonable cost. AGPS for use with vehicles can comprise a communications unit with a GPS receiver arranged in the vehicle, an AGPS server with a reference GPS receiver that can simultaneously "see" the same satellites as the communications unit, and a wireless network infrastructure consisting of base stations and a mobile switching center.

The network can accurately predict the GPS signal the communication unit will receive and convey that information to the mobile or vehicle, greatly reducing search space size and shortening the TTFF from minutes to a second or less. In addition, an AGPS receiver in the communication unit can detect and demodulate weaker signals than those that conventional GPS receivers require. Because the network performs the location calculations, the communication unit only needs to contain a scaled-down GPS receiver. It is accurate within about 15 meters when they are outdoors, an order of magnitude more sensitive than conventional GPS.

A transponder 268 can also be placed in the license plates 287 (FIG. 1A) of all vehicles at nominal cost. An appropriately equipped vehicle can then determine the angular location of vehicles in its vicinity. Thus, once again, a single interrogator coupled with multiple antenna systems can be used for many functions (see FIG. 1). Alternately, if more than one transponder 268 is placed on a vehicle spaced apart from one another and if two antennas are on the other vehicle, then the direction and position of the vehicle can be determined by the antenna-equipped, receiving vehicle.

Transponders 268 are contemplated by the inventor to include SAW, RFID or other technologies, reflective or back scattering antennas, polarization antennas, rotating antennas, corner cube or dihedral reflectors etc. that can be embedded within the roadway or placed on objects beside the roadway, in vehicle license plates, for example. An interrogator 10 within the vehicle transmits power to the transponder 268 and receives a return signal. Alternately, as disclosed in U.S. Pat. No. 6,405,132, the responding device can have its own source of power so that the vehicle-located interrogator 10 need only receive a signal in response to an initiated request. The source of power can be a battery, connection to an electric power source such as an AC circuit, solar collector, or in some cases, the energy can be harvested from the environment where vibrations, for example, are present. The range of a license-mounted transponder 268, for example, can be greatly increased if such a vibration-based energy harvesting system is incorporated.

Figure 1A:
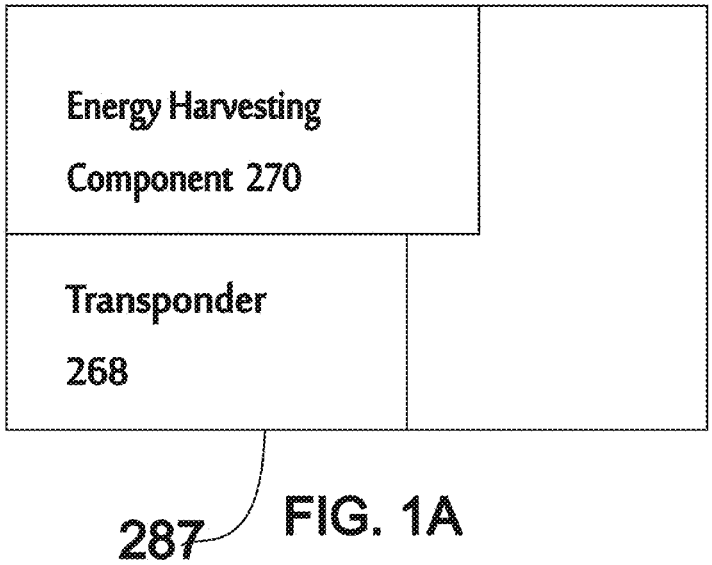
FIG. 1A illustrates a license plate with a transponder powered by an energy harvesting component.

In view of the foregoing, a license plate 287 for a vehicle in accordance with the invention could include a plate having an indicia and arranged to be mounted on the vehicle, as a conventional license plate, and a transponder 268 arranged in the license plate 287 (see FIG. 1A). The transponder 268 is arranged to receive a signal from an interrogator, e.g., a vehicle-mounted interrogator 10 or infrastructure-mounted interrogator, modify the received signal and transmitted the modified signal to the interrogator 10. The transponder 268 may be a SAW transponder, an RFID transponder, and include a reflective or back scattering antenna, a polarization antenna, a rotating antenna, or a corner cube or dihedral reflector, etc., as mentioned above. Further, an energy harvesting component 270 can be arranged in connection with the license plate 287 for providing power to the license plate-mounted transponder 268. The energy harvesting component 270 may be arranged to generate energy during or from movement or vibration of the vehicle 290. Another construction of a license plate 287 includes a plate having an indicia and arranged to be mounted on the vehicle and an RFID tag (as transponder 268) arranged as part of the license plate 287. The RFID tag is arranged to respond to an activation signal and provide the type, size and mass of the vehicle to which the license plate 287 is mounted. The type of vehicle may be an indication of whether the vehicle has special travel privileges.

Yet another embodiment of a SAW sensor in accordance with the invention comprises a substrate made of a material on which a wave is capable of traveling, first and second interdigital transducers arranged on the substrate, at least one antenna coupled to the first and second interdigital transducers, and first and second reflectors spaced from the at least one interdigital transducer such that two properties of the substrate are measured. A coating of a material sensitive to pressure is optionally arranged on the substrate between the first interdigital transducer and the first reflector. The coating can comprise at least one oxygen or nitrogen sensing material. If two antennas are provided, each may be coupled to a respective one of the first and second interdigital transducers. Optionally, a material is arranged on the substrate which is sensitive to the presence or concentration of a gas, vapor, or liquid chemical. Also, a coating of a material sensitive to carbon dioxide may be arranged on the substrate between the first interdigital transducer and the first reflector.

Still another embodiment of a SAW sensor in accordance with the invention comprises a substrate made of a material on which a wave is capable of traveling, an interdigital transducer arranged in connection with the substrate, an antenna coupled to the interdigital transducer, at least one reflector spaced from the interdigital transducer, and at least one coating of a material sensitive to carbon dioxide arranged on the substrate between the interdigital transducer and the reflector such that the sensor provides a measurement of the presence of carbon dioxide. Although carbon dioxide is disclosed, materials are available which will absorb a variety of other chemicals which could indicate atmospheric pollution or chemical warfare. Sensor and communication systems in the field as disclosed can be used to warn passing motorists and thereby others though an Internet connection by the passing vehicles that such chemicals were present in the atmosphere.

In another implementation of the invention, a passing vehicle 290 which has knowledge of a potentially hazardous condition on or near the roadway, i.e. black ice, an animal, a pedestrian, can transmit this information to a local solar powered sensor and communication system allowing that system to display a visual warning to future passing vehicles. In this manner, information relative to a particular area of the roadway can be spread to give motorists an advanced warning. This warning can be in the form of a RF transmission to the vehicle 290, a variable sign, or a blinking LED light as described herein.

For example, black ice can be determined by a properly equipped vehicle which is capable of measuring the friction coefficient between its tires and the roadway.

Based on the frequency and power available, and on FCC limitations, SAW devices can be designed to permit transmission distances of up to 100 feet or more if powered. Since SAW devices can measure both temperature and humidity, they are also capable of monitoring road conditions in front of and around a vehicle. Thus, a properly equipped vehicle can determine the road conditions prior to entering a particular road section if such SAW devices are embedded in the road surface or on mounting structures close to the road surface as shown at 279 in FIG. 2. Such devices could provide advance warning of freezing conditions, for example. Although at 60 miles per hour, such devices 279 may only provide a one second warning, this can be sufficient to provide information to a driver, or to an automatic control or guidance system which controls the movement of the vehicle, to prevent dangerous skidding. Additionally, since the actual temperature and humidity can be reported, the driver will be warned prior to freezing of the road surface.

SAW device 279 is shown in FIG. 2A. Optional components of a sensor including the SAW device 279, or another type of physical property measuring or detecting sensor, are also shown which may also be provided to SAW device 283 discussed above. These optional components include a proximity sensor 272 which can sense a vehicle within a predetermined threshold distance from the SAW device 279, i.e., to define an area proximate the SAW device 279, and is arranged to cause the SAW device 279 or other sensor to perform its measurement. As such, the SAW device 279 or other sensor could transmit the information about the measured property to the vehicle as it approaches the SAW device 279 or other sensor. Another optional component is an energy harvesting system 274 which, when the SAW device 279 or other sensor requires energy to operate, functions to provide such energy, e.g., electricity. The energy harvesting system could generate electricity from, for example, vibratory and solar sources. As mentioned elsewhere, the proximity sensor 272 can be a sensor which senses the thermal emissions from the vehicle, a sensor which senses the sound of the vehicle, a camera or other optical sensor which can determine the presence of a vehicle, a radar or laser radar (lidar) sensor or any other sensor which can detect the proximity of a vehicle to the mounting structures.

SAW device 279 represents a general measuring or detecting component that measures or detects a property or condition of the travel surface on which the SAW device is embedded, possibly in a housing resistant to the force of vehicles passing over it. The proximity sensors represents a general detecting sensor that detects the presence of a vehicle within a set distance therefrom and which may be embedded in the travel surface or located in a stationary mounting structure in a vicinity of the travel surface and apart from the travel surface. In one embodiment, each measuring or detecting component (SAW device 279) is activated to measure or detect a property or condition of the travel surface or the environment around the travel surface only when the detecting sensor (proximity sensor 272) coupled thereto detects the presence of a vehicle within the set distance from the detecting sensor.

The energy harvesting system 274 is coupled to the detecting sensor and its coupled measuring or detecting component, and generates energy and provides the generated energy to the measuring or detecting component and to the detecting sensor to enable them to perform their functions. A communication system is part of or coupled to each measuring or detecting component. As shown in FIG. 2A, the communication system 260 is part of the SAW device 279. However, the communication system 260 represents any communication system that communicates or conveys the property or condition being measured or detected by the measuring or detecting component to the vehicle or occupant thereof, whether only after the measuring or detecting component is activated by the vehicle presence detecting sensor or otherwise, or whether directly without an intermediary or intervening component or indirectly. When integrated into the SAW device 279, the communication system 260 would provide a return wireless signal to a receiver on the vehicle, e.g., an antenna. However, the communication system 260 may alternatively be a visual display, audio display, wireless transmission to a navigation system on the vehicle, and the like.

Accordingly, the communication initiated using the communication system 260 associated with each SAW device, or other sensor, may be a wireless transmission intended for reception by a vehicular navigation system, in which case, operation of the navigation system is changed from an existing operating state to one of the plurality of different operating states as a result of reception of the wireless transmission. The property or condition measured or detected by the measuring or detecting component of the SAW device determines the different operating state. For example, a measurement of ice on the travel surface may cause the control and/or guidance of the system to exert braking force to slow the vehicle.

Furthermore, the determination of freezing conditions of the roadway could also be transmitted to a remote location, such as a road monitoring or maintenance facility or traffic monitoring facility, where such information is collected and processed. All information about roadways in a selected area could be collected by the roadway maintenance department and used to dispatch snow removal vehicles, salting/sanding equipment and the like. To this end, the interrogator would be coupled to a communications device arranged on the vehicle and capable of transmitting information using the cell phone network, via a satellite, ground station, over the Internet and via other communications means. A communications channel could also be established to enable bi-directional communications between the remote location and the vehicle.

The information about the roadway obtained from the sensors by the vehicle can be transmitted to the remote location along with data on the location of the vehicle, obtained through a location-determining system possibly using GPS technology. Additional information, such as the status of the sensors, the conditions of the environment obtained from vehicle-mounted or roadway-infrastructure-mounted sensors, the conditions of the vehicle obtained from vehicle-mounted sensors, the occupants obtained from vehicle-mounted sensors, etc., could also be transmitted by the vehicle's transmission device or communications device to receivers at one or more remote locations. Such receivers could be mounted to roadway infrastructure or on another vehicle. In this manner, a complete data package of information obtained by a single vehicle could be disseminated to other vehicles, traffic management locations, road condition management facilities and the like. So long as a single vehicle equipped with such a system is within range of each sensor mounted in the roadway or along the roadway, information about the entire roadway can be obtained and the entire roadway monitored.

Figure 3:
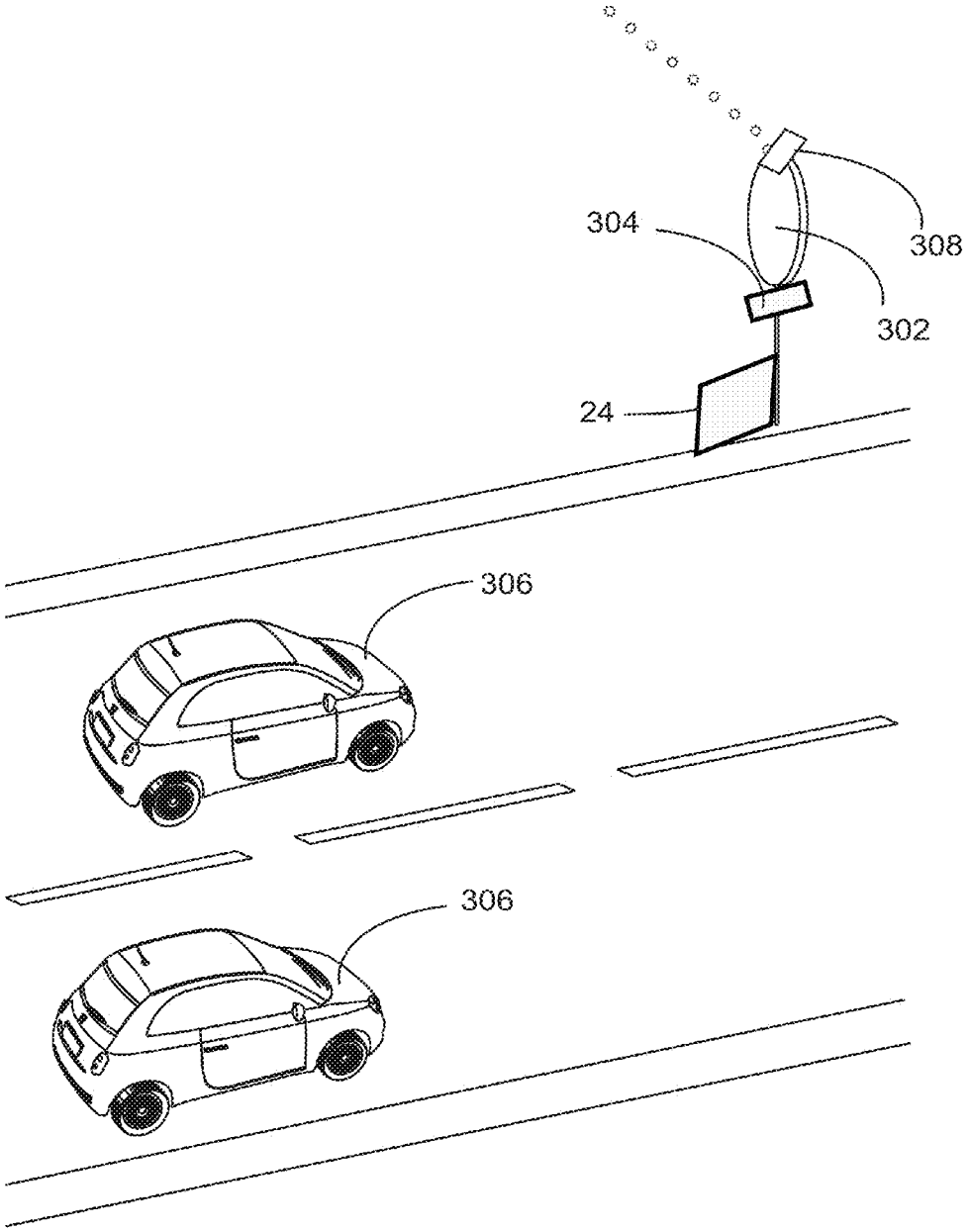
FIG. 3 shows a sign containing a camera, radar or laser (lidar) sensor for detecting the approach of a vehicle.

The sensor and communication system of this invention is illustrated in FIG. 3 which shows a road sign 302 containing a camera, radar or laser (lidar) sensor 304 for detecting the approach of a vehicle. Either of these sensors is capable of determining the position and velocity of the oncoming vehicle 306 and can activate the communication system 24 associated with the sign 302 upon such a determination that a vehicle 306 is approaching. Providing there is a straight stretch of roadway, these devices can make this determination while the approaching vehicle 306 is still several hundred feet away providing sufficient time for the sign 302 and/or other communication system 24 to be activated allowing the driver of the vehicle 306 sufficient time to reduce the vehicle's speed, assuming this is the desired result.

Figure 4:
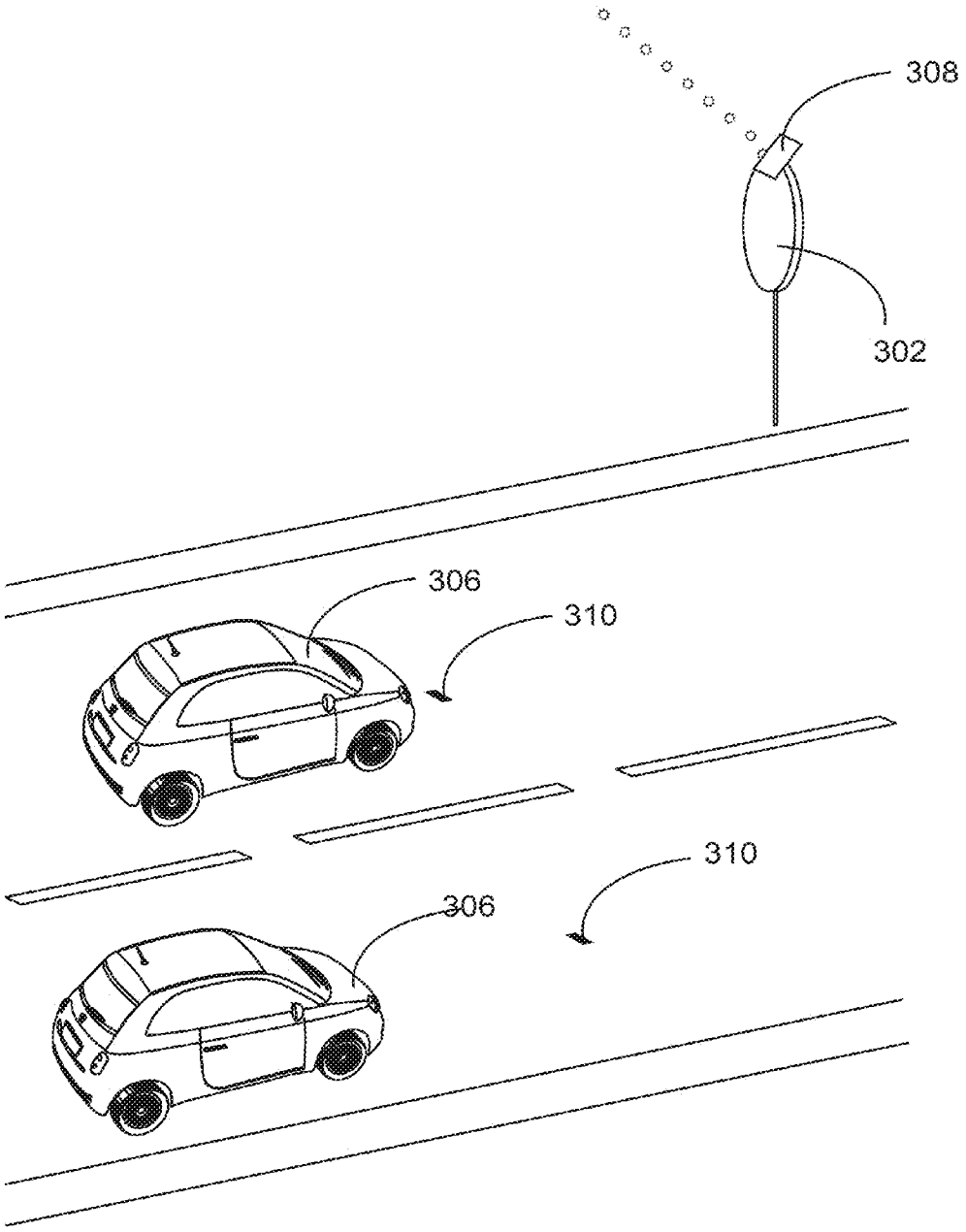
FIG. 4 illustrates a sensor and communication system comprising a sign with a solar energy harvesting system and vehicle presence sensors embedded in the road.

FIG. 4 illustrates an arrangement similar to FIG. 3 with road-mounted vehicle sensors 310. Such sensors 310 can be active and equipped with a battery or other power source or passive sensors which sends the vibration or magnetic proximity of a vehicle or they can be passive transponders which react to an interrogating signal from the passing vehicle 306. Thus, sensors 310 may be activatable sensors that are activated only when certain activating conditions are satisfied, e.g., presence of a vehicle within a set distance of the sensor 310 is detected whether by thermal, optic or other means. In either case, the sign 302 receives a transmission either from the vehicle 306 or from the sensor 310 and thus knows that a vehicle 306 is approaching. The sign 302 can have an energy harvesting system 308 using a solar panel or other source of renewable energy such as a windmill, not shown. The sensors 310 fulfill a similar function as the camera, radar or lidar sensor 304 in FIG. 3. The solar energy harvesting system 308 combined with a battery, not shown, can provide sufficient energy to power an electric sign 302 providing the duty cycle is sufficiently low as to not drain the battery.

Figure 5:
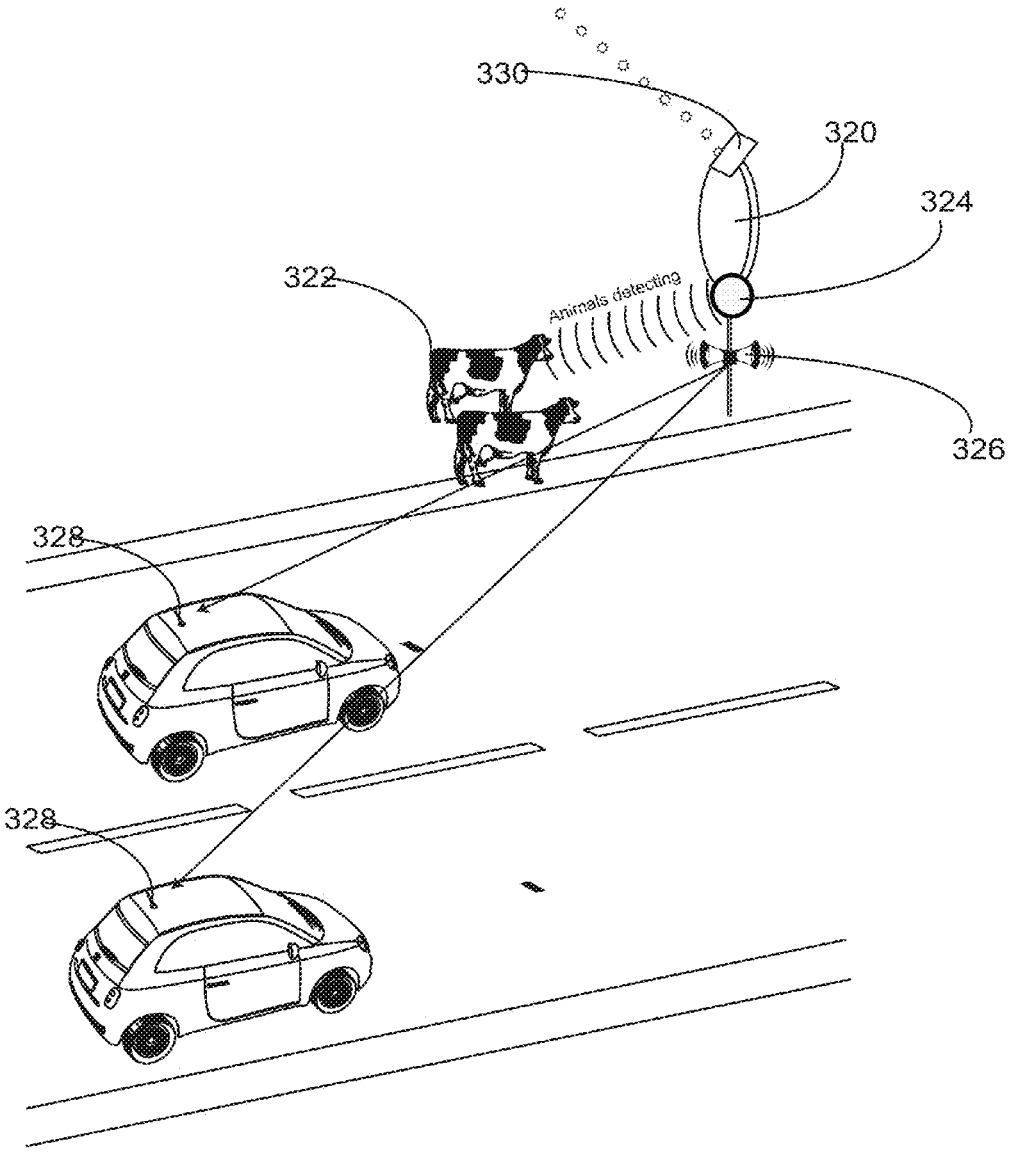
FIG. 5 illustrates the use of a sensor and communication system for detecting the presence of animals in the vicinity of a roadway and for communicating this information to approaching vehicles.

FIG. 5 illustrates the use of a sensor and communication system for detecting animals 322 in the vicinity of the roadway. This detection can be accomplished using a camera, thermal IR sensors, microphones, ultrasound or other motion detecting sensors, represented by 324. Note that although sensor 324 is shown on the same mounting structure as the remaining components of the system the components may be separately mounted on different support structure (which is also applicable for the other embodiments disclosed herein).

When the presence of an animal 322 is detected, then the vehicle-approach sensors 310 can be activated, if they require energy, and when they indicate the approach of a vehicle 328, a sign 320 can be illuminated, a light can start blinking, or other audio, visual or electromagnetic communication system 326 activated to inform the driver of the approaching vehicle 328 that animals 322 are present. The animals 322, shown here as cows, can be deer, elk, moose or any other animal which could cause significant damage if it impacted with an automobile or truck.

Figure 6:
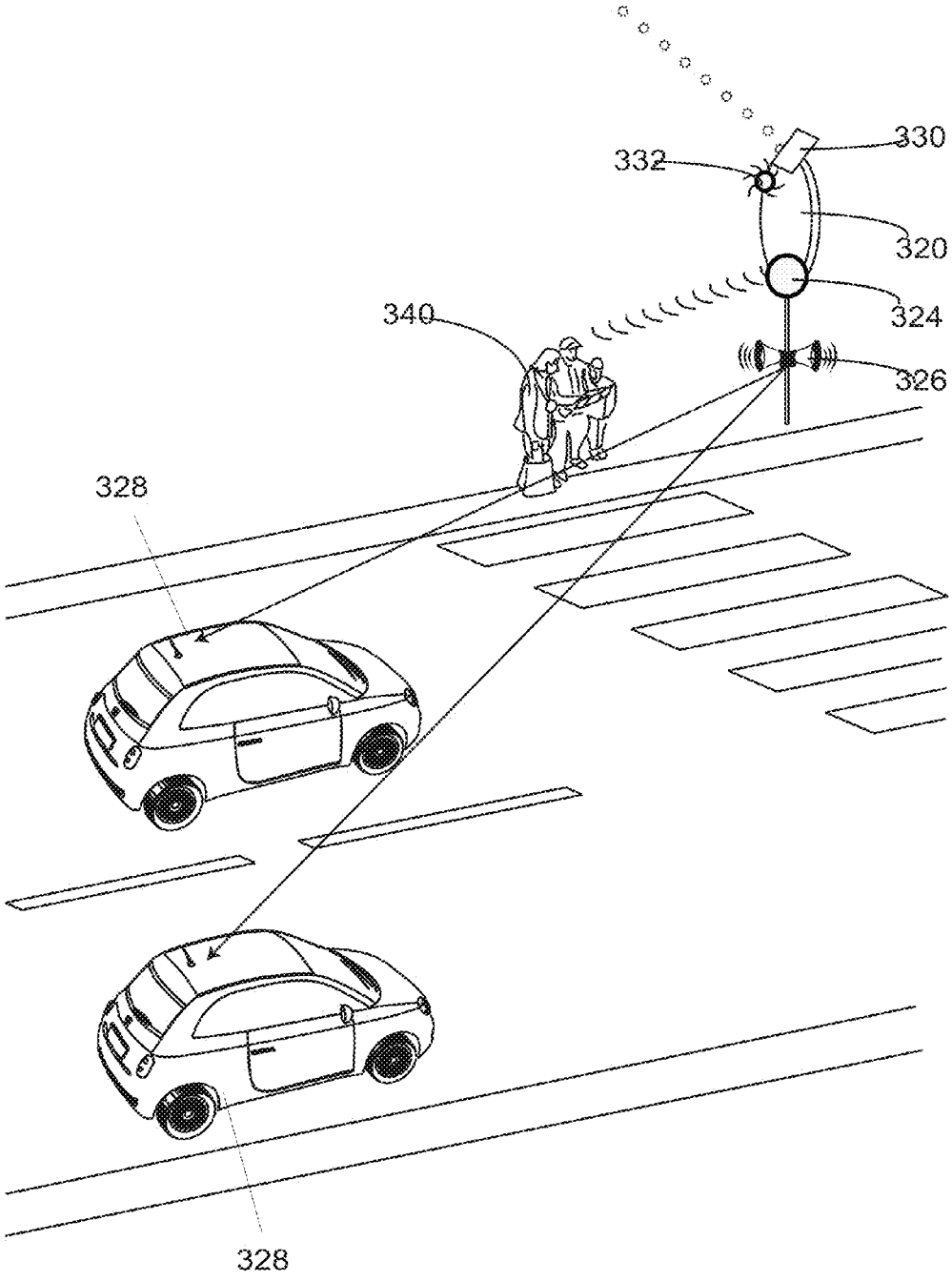
FIG. 6 illustrates the use of a sensor and communication system for detecting the presence of pedestrians in a crosswalk near the roadway and for communicating this information to approaching vehicles.

FIG. 6 illustrates the use of a sensor and communication system for detecting the presence of pedestrians 340 near the roadway. Pedestrians are frequently killed or injured when they attempt to cross a road and are not seen by the driver of approaching vehicles 306. A sensing system 324 detects the presence of one or more pedestrians 340 through the use of a camera, thermal IR sensor, radar, lidar, ultrasound, or other appropriate sensor, and can then be used to activate a warning sign 320, blinking light 332, sound, or other communication system 330 to an approaching vehicle to warn the vehicle of the presence of the pedestrians 340 (see FIG. 5). Quite often, pedestrians believe that they have the right of way to cross a street and the vehicle should stop to permit this passage. However, the vehicle driver does not see the pedestrian and a fatality or injury ensues. This is particularly a problem with deaf, blind, or otherwise challenged pedestrians or with pedestrians which are distracted through cell phone or texting use.

Figure 7B:
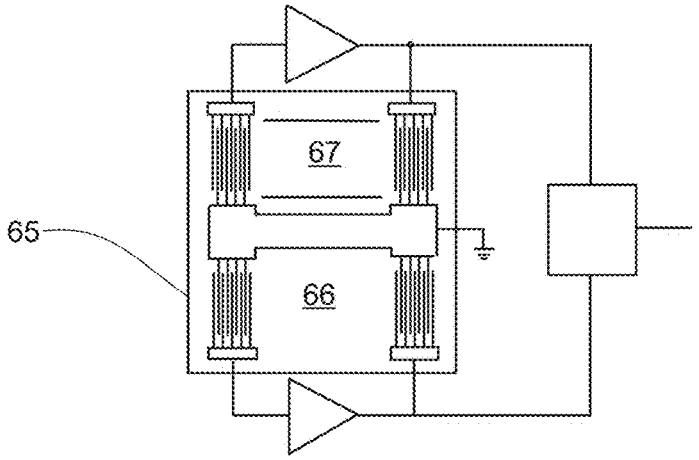
FIG. 7B is a top view of an alternate SAW device capable of determining two physical or chemical properties such as pressure and temperature.
Figure 7A:
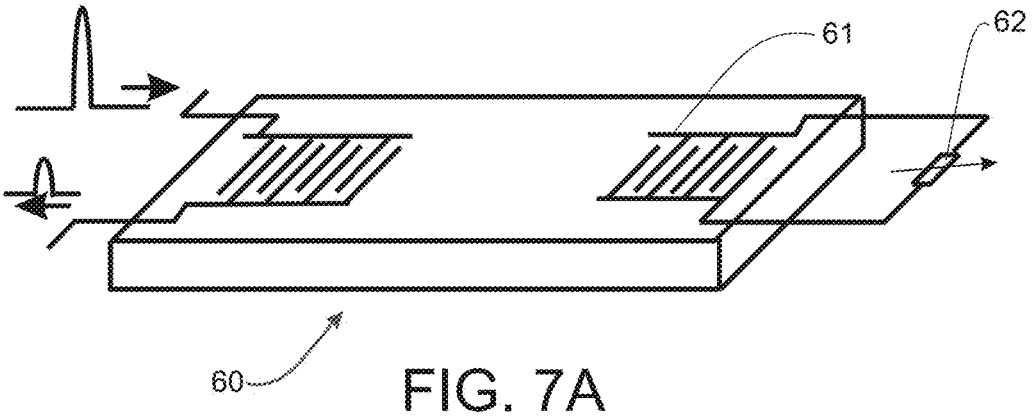
FIG. 7A is a perspective view of a device that can provide a measurement of temperature or of some other physical or chemical property such as pressure or chemical concentration.
Figure 7:
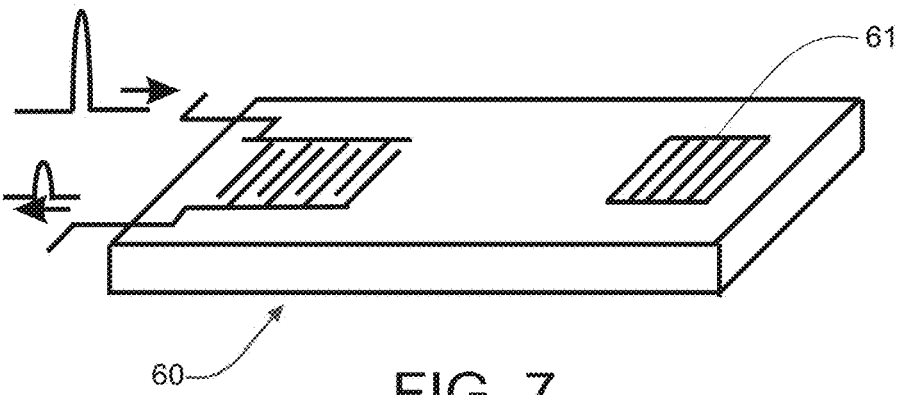
FIG. 7 illustrates a SAW temperature sensor.

A SAW temperature sensor 60 is illustrated in FIG. 7. Since the SAW material, such as lithium niobate, expands significantly with temperature, the natural frequency of the device also changes. Thus, for a SAW temperature sensor to operate, a material for the substrate is selected which changes its properties as a function of temperature, i.e., expands. Similarly, the time delay between the insertion and retransmission of the signal also varies measurably. Since speed of a surface wave is typically 100,000 times slower than the speed of light, usually the time for the electromagnetic wave to travel to the SAW device and back is small in comparison to the time delay of the SAW wave and therefore the temperature is approximately the time delay between transmitting electromagnetic wave and its reception.

An alternate approach as illustrated in FIG. 7A is to place a thermistor 62 across an interdigital transducer (IDT) 61, which is now not shorted as it was in FIG. 7. In this case, the magnitude of the returned pulse varies with the temperature. Thus, this device can be used to obtain two independent temperature measurements, one based on time delay or natural frequency of the device 60 and the other based on the resistance of the thermistor 62.

When some other property such as pressure is being measured by the device 65 as shown in FIG. 7B, two parallel SAW devices are commonly used. These devices are designed so that they respond differently to one of the parameters to be measured. Thus, SAW device 66 and SAW device 67 can be designed to both respond to temperature and respond to pressure. However, SAW device 67, which contains a surface coating, will respond differently to pressure than SAW device 66. Thus, by measuring natural frequency or the time delay of pulses inserted into both SAW devices 66 and 67, a determination can be made of both the pressure and temperature, for example. Normally, however, pressure sensitivity is achieved differently by placing the SAW device on a membrane which is on the top of a sealed chamber. The chamber contains a gas at known pressure and the membrane flexes in response to the differential pressure across the membrane. This flexing of the SAW changes its natural frequency or the time required for a pulse to be returned and thus the pressure can be determined. Naturally, the device which is rendered sensitive to pressure in the above discussion could alternately be rendered sensitive to some other property such as the presence or concentration of a gas, vapor, or liquid chemical as described in more detail below.

Note that any of the disclosed applications can be interrogated by the central interrogator of this invention and can either be powered or operated powerlessly as described in general above. Block diagrams of three interrogators suitable for use in this invention are illustrated in FIGS. 8A-8C, and their operating mode can be readily understood by those skilled in the electronics field. FIG. 8A illustrates a superheterodyne circuit and FIG. 8B illustrates a dual superheterodyne circuit. FIG. 8C operates as follows. During the burst time two frequencies, F1 and F1+F2, are sent by the transmitter after being generated by mixing using oscillator Osc. The two frequencies are needed by the SAW transducer where they are mixed yielding F2 which is modulated by the SAW and contains the information. Frequency (F1+F2) is sent only during the burst time while frequency F1 remains on until the signal F2 returns from the SAW. This signal is used for mixing. The signal returned from the SAW transducer to the interrogator is F1+F2 where F2 has been modulated by the SAW transducer. It is expected that the mixing operations will result in about 12 db loss in signal strength.

FIG. 9 illustrates the concepts of this invention applied to a multilane highway where a sign might not be visible from all of the lanes. In this case, an overhead gantry 298 is provided for holding a sign 296. Grid power is likely to be present so that a solar energy panel is not required. Sensors on poles 64, 65 are provided as well as vehicle presence and/or road conditions sensors 63 shown embedded in the roadway.

Further, FIG. 9 shows one way to convey the driving condition information generated by sensors 63, whether roadway embedded or mounted on stationary structures 64, 65 proximate or on the roadway as disclosed above, to the driver or other vehicle occupant. This way involves directing the sensor-generated information to a sign 296 on the gantry 298 which may be at the location of the sensors 63 or after the sensors 63 in the travel direction of the roadway. The gantry 298 may be 50, 100, 200, 300 feet downward of the sensors 63 to allow for time to generate information and direct this information to the sign 296 for display. An audio generator 300 may also be arranged on the gantry 298 for generating an audio notification to the driver or vehicle occupant.

Figure 10:
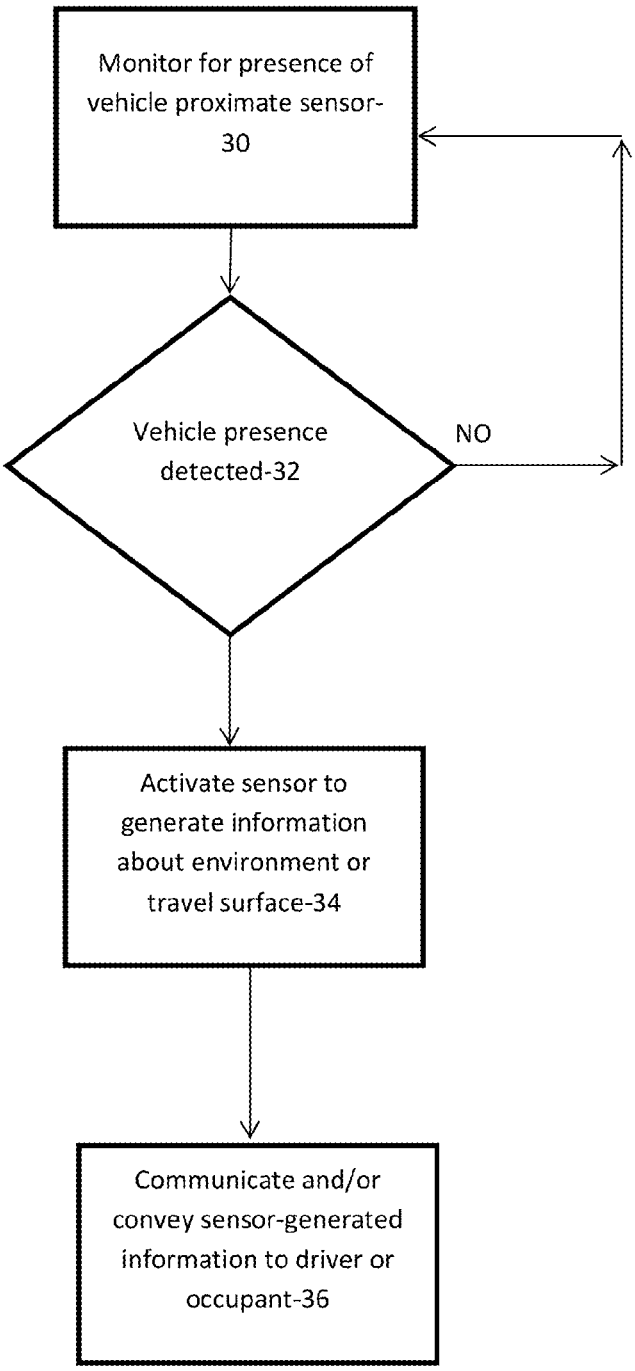
FIG. 10 is a flow chart showing a method in accordance with the invention.

Referring now to FIG. 10, a method for conveying driving conditions in accordance with the invention includes an initial step of monitoring for the presence of a vehicle at activatable sensors (step 30). As described above, these activatable sensors may be located in stationary mounting structures in a vicinity of a roadway and apart from the roadway, embedded in a roadway or a combination of both mounting techniques may be used. Also, the sensors are configured to generate information about the roadway or an environment around the roadway.

To this end, each sensor includes a measuring or detecting component that measures or detects a property or condition of the roadway or the environment around the roadway. Preferably, each sensor also includes or is connected to an energy harvesting system that generates energy and provides the generated energy to the measuring or detecting component to enable the measuring or detecting component to measure or detect the property or condition of the roadway or environment around the roadway. Reciting that the component measures or detects a property or condition is not intended to limit the functionality of the component and it may, additionally or alternatively, perform other functions similar to measuring and detecting and perform such functions on characteristics other than a property or condition of the roadway or environment around the roadway.

More specifically, an indication of the presence of a vehicle may be obtained by coupling a proximity sensor to the activatable sensor that determines when a vehicle is within a set distance from the activatable sensor. The proximity sensor may be configured to sense thermal emissions from the vehicle or sound of the vehicle, or constitute or include a camera or other optical sensor that obtains images from which proximity of the vehicle to the activatable sensor is determinable, a radar or laser radar (lidar) sensor. If images are obtained, they can be analyzed in a manner known to those skilled in the art, to determine the distance between the activatable sensor and the vehicle, e.g., whether it is above or below a threshold that controls activation of the activatable sensor.

This monitoring step 30 continues, via a loop with determination step 32, until an indication of the presence of a vehicle proximate the sensor is obtained. Since this monitoring may be passive, energy is not consumed.

In step 34, when an indication of the presence of a vehicle is obtained by one of the sensors, the sensor is activated to enable a communication of the sensor-generated information directly from each of the sensors to the vehicle or occupant thereof when the vehicle is detected proximate the sensor. Thus, there may be a sequential activation of sensors on a roadway during the movement of the vehicle toward each sensor. An indication of the presence of a vehicle may involve transmission of an activation signal from an interrogator on the vehicle, and the sensors can include a power-receiving system that receives power wirelessly from the interrogator.

In step 36, the sensor-generated information is communicated or conveyed when the sensor is activated. Options for step 36 include a communication or conveyance directly to a vehicle, e.g., the navigation system of the vehicle to cause an alarm to be presented on a display thereof. The communication from each sensor to the vehicle may be a wireless transmission of a signal, i.e., the sensors are configured to wirelessly transmit the signal directly to the vehicle. Another communication or conveyance may be directly to an occupant of the vehicle, e.g., by means of a sign located in front of the vehicle or otherwise providing a visual indication from a stationary mounting structure at a location proximate the sensor. The communication from each sensor to the sign may be a wireless transmission of a signal, i.e., the sensors are configured to wirelessly transmit the signal directly to the sign. Another conveyance is to provide an audio indication from a stationary mounting structure at a location proximate the sensor.

The sensor is thus configured to communicate the generated information directly to the vehicle or occupant thereof. The sensor-generated information is preferably not communicated from each sensor until that sensor activated. However, a sensor may be activated based on activation of another sensor upstream of the travelling vehicle. A sensor may be a RFID type sensor configured to return information directly to the vehicle or occupant thereof in the form of a modulated RF signal such that the communication from each sensor is wireless transmission of the modulated RF signal. After activation, each sensor may revert to a deactivated state until reactivated by another vehicle or sensor.

Additional configurations of the sensor include to generate information about travel conditions relating to the roadway, to generate information about external objects on or in the vicinity of the roadway that potentially affect travel on the roadway, to communicate an identification code indicative of its position with the information generated by the sensor when activated directly to the vehicle or occupant thereof, to measure friction of a surface of the roadway, atmospheric pressure, measure atmospheric temperature, temperature of the roadway, moisture content of the roadway or humidity of the atmosphere, and/or to communicate the generated information after a delay such that the sensors use time-multiplexing such that each sensor has a different delay.

Figure 11:
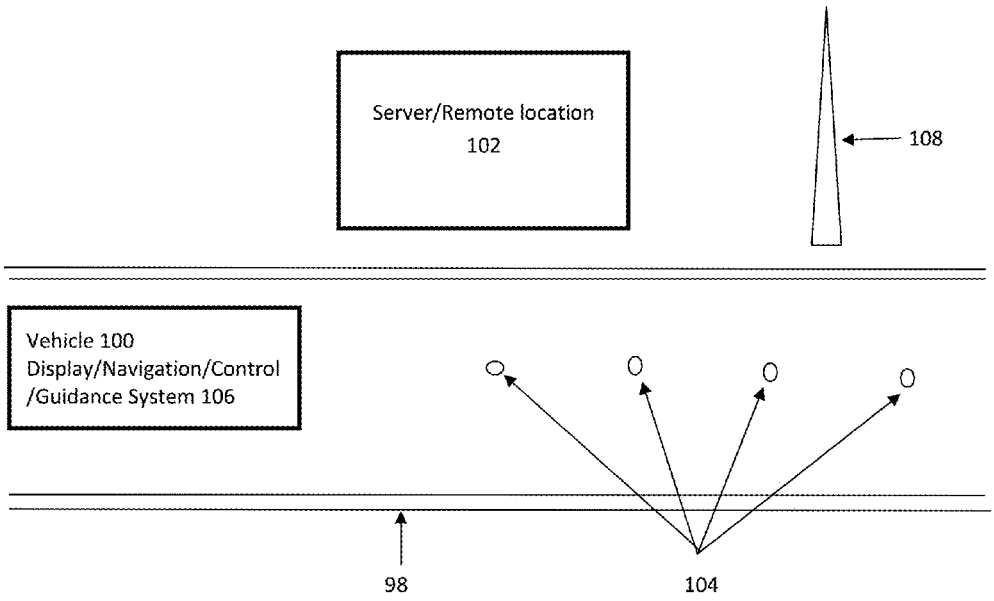
FIG. 11 is a schematic used to explain the manner in which a driving condition information method is used in the invention.

Referring now to FIG. 11, a vehicle 100 travels on a travel surface or roadway 98 and receives information to affect its operation from sensors 104 fixed in position relative to the travel surface 98. The information generated by the sensors 104 is generally about the travel surface 98 or an environment around the travel surface 98, as described above. Thus, each sensor 104 includes a measuring or detecting component that measures or detects a property or condition of the travel surface 98 or the environment around the travel surface 98 that affects interaction between tires and the travel surface 98.

The embodiment described with respect to FIG. 11 does not require proximity sensors arranged in each sensor 104. However, the embodiment is based on a similar proximity notification system, i.e., only when a vehicle is within the set distance from one of the sensors, is a communication of the information generated by that sensor to the vehicle initiated. A communication of the information generated by each sensor is thus not initiated unless a vehicle is within the set distance from that sensor. As described above, determining when a vehicle on the travel surface is within the set distance from each sensor involves use of a proximity sensor coupled to each sensor, with the proximity sensor using a thermal system, a sound sensing system, an optic system, radar or laser radar (lidar) to analyze proximity of a vehicle to the respective one of the sensors. Additionally, the proximity sensor can include a camera or other optical sensor that obtains images to be analyzed to assess a distance between the sensor and the vehicle.

Now, it is possible to assess distance between the vehicle 100 and each sensor 104 by coupling the sensors 104 to the Internet (as an example of a telecommunications and data network) or, alternately, a dedicated short range communications (DSRC) system. Such systems typically require transmission devices such as a tower 108. As the vehicle 100 approaches the sensor 104, an application on the internet, e.g., being executed by a server 102 at a remote location, or on the vehicle 100 communicates with a processor at the server 102 and causes completion of a transmission of the information generated by the sensor 104 to the vehicle, i.e., a report on the condition of the sensor 104 is provided to the vehicle 100. Thus, while a communication of the sensor-generated information is imitated initiated based on proximity of the vehicle 100 to the sensor 104, the transmission is completed using the Internet or the DRSC network.

In one embodiment, the position of the vehicle 100 (derived using a positioning system partly on the vehicle 100 such as a GPS system) is provided to the processor at the server 102 and the processor at the server 102, knowing the position of the sensors 104 on the travel surface 98 on which the vehicle 100 is travelling, is able to perform the determination when the vehicle 100 is within the set distance from the sensors 104. The processor at the server 102 may be provided with or derive the position of the sensors 104 based on information included in the communications from the sensors 104, i.e., each sensor is configured to include an identification code indicative of its position with the communication. If the vehicle is determined to be within the set distance from one of the sensors 104, the processor at the server 102 initiates a communication of the information generated at each sensor 104 to the vehicle 100. This information may be obtained only after the processor makes the determination of the vehicle 100 being within the set distance from the sensor 104, or the processor at the server 102 may store information provided by the sensors 104, and if current (i.e., within a set range of time such as 1 minute), provide the stored information to the vehicle 100. Proximity of the vehicle 100 thus completes the transmission of the information generated by the sensor 104 to the vehicle 100. Otherwise, the processor at the server 102 could direct the sensor 104 to provide new information when the vehicle 100 is determined to be within the set distance from the sensor 104, for ultimate forwarding to the vehicle 100.

Accordingly, in one embodiment, the sensors 104 are coupled to a server 102 using a telecommunications and data network (represented by tower 108), the server 102, which is at a location separate and apart from the vehicle 100 and other vehicles participating in the method, receives the communications of the information generated by each sensor 104, determines when a vehicle 100 on the travel surface 98 is within the set distance from each sensor 104, and transmits the information generated by each sensor 104 to the vehicle 100 using the telecommunications and data network 108 (or DRSC) only when the vehicle 100 on the travel surface 98 is determined to be within the set distance from each sensor 104.

Upon receipt of the information generated by the sensors 104 at the vehicle 100, a display, navigation, control and/or guidance system 106 in the vehicle 100 changes from an existing operating state to one of a plurality of different operating states as a result of reception of the communication from the sensors 104. The specific one of the different operating states to which the display, navigation, control or guidance system is changed is determined based on the communication.

Figure 12:
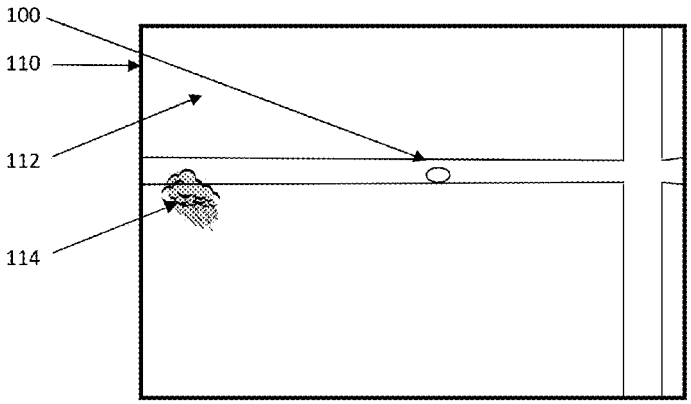
FIG. 12 is an example of a display of, for example, a vehicular navigation system showing display of an object on a map derived using a method in accordance with the invention.

As shown in FIG. 12, if a sensor 104 provides an indication of the travel surface 98 being wet, the indication may be converted into a icon 114 of a rain cloud, and a display 110 of the vehicle or of a navigation system in the vehicle caused to change its operation to display the icon 114 on a map 112 including position of the vehicle 100. As such, the visual indication of the content of the communication is placed on the map 112 as the vehicle 110 approaches the position of the sensor 114. Different icons or other symbols may be used to represent different conditions.

An app could also be designed to be executed by the processor on the vehicle 100, e.g., included in one or more of the display, navigation, control and/or guidance system 106 in the vehicle 100, that automatically places an icon on a vehicle resident map as the vehicle approaches the location of the sensor that caused the generation of the icon. The icons may be selected from a plurality of different icons, each representing a particular condition or state of the travel surface or the environment around the travel surface. The invention also includes a computer program stored in computer-readable medium that is linked to a vehicle 100, the display, navigation, control and/or guidance system 106 in the vehicle 100, sensors 104, a communications and data network (represented by tower 108) and a server 102 at which the computer program may be executed. The program receives vehicle position from, for example, an on-board positioning system using GPS, receives position of sensors fixed relative to a travel surface (either initially upon programming or included in communications from such sensors) and compares the positions to determine when the vehicle is approaching or within a set distance from one of the sensors. The program then causes information generated by that sensor to be transmitted to that vehicle, for use by that vehicle to alter operation of a vehicular component, e.g., the navigation system. A proximity based information providing system is therefore established.

The sensors 104 may continually provide information to the program to be stored in a database for use whenever a vehicle 100 is determined to be within the set distance from a sensor. Or, the computer program may direct a sensor to initiate a communication including sensor-generated information only after the vehicle is proximate the sensor.

The program may reside in a handheld electronics device and be present in the vehicle, e.g., a smartphone used by an occupant of the vehicle.

Using the program, the sensors 104 are connected via a telecommunications and data network which is also accessible by the smartphone, and as the vehicle 100 approaches the sensor 104, the program reports the condition of the sensor 104 to the vehicle 100. For example, the program can cause an icon representing the reported condition to be placed on a vehicle resident map automatically as the vehicle 100 approaches the location of the sensor 104 (see FIG. 12).

Many changes, modifications, variations and other uses and applications of the subject invention will now become apparent to those skilled in the art after considering this specification and the accompanying drawings which disclose preferred embodiments thereof. All such changes, modifications, variations and other uses and applications which do not depart from the spirit and scope of the invention are deemed to be covered by the invention which is limited only by the following claims.

The invention claimed is:

1. A method for conveying driving conditions to a vehicle on a travel surface and using the conveyed driving conditions for vehicular control, comprising:

determining, using a proximity notification system, when the vehicle is within a set distance from any of a plurality of sensors fixed in position relative to the travel surface, each of the sensors generating information about the travel surface or an environment around the travel surface and including a measuring or detecting component that measures or detects a property or condition of the travel surface or the environment around the travel surface that affects interaction between tires and the travel surface and which is part of the generated information; and as a result of the determination that the vehicle is within the set distance from any of the plurality of sensors fixed in position relative to the travel surface by the proximity notification system, directing, using a communication system having a transmitter off of the vehicle and a receiver on the vehicle, the information generated by one of the sensors to the vehicle determined to be within the set distance from the one of the sensors by the proximity notification system, whereby the information generated by each of the sensors is not directed to the vehicle unless the vehicle is determined to be within the set distance from that sensor by the proximity notification system, and whereby in response to the vehicle receiving the generated information being directed to the vehicle, operation of at least one of a display, navigation, control and guidance system in the vehicle changes from an existing operating state to one of a plurality of different operating states, the specific one of the different operating states to which the display, navigation, control or guidance system is changed being determined based on the generated information.

2. The method of claim 1, wherein the change in operation of at least one of the display, navigation, control and guidance system in the vehicle determined to be within the set distance from the one of the sensors by the proximity notification system is presentation of a visual indication of content of the generated information on a map shown on a display of the display system such that the visual indication of the content of the generated information is placed on the map as the vehicle approaches the position of the one of the sensors.

3. The method of claim 1, wherein each of the sensors is configured to include an identification code indicative of its position with the generated information.

4. The method of claim 1, wherein the sensors are coupled to a telecommunications and data network, further comprising transmitting the information generated by the one of the sensors, initiated only when the vehicle is determined to be within the set distance from the one of the sensors, to the vehicle determined to be within the set distance from the one of the sensors by the proximity notification system, using the telecommunications and data network.

5. The method of claim 1, wherein the sensors are coupled to a telecommunications and data network, further comprising:

receiving, at a remote location, the information generated by each of the sensors, the step of directing, using the communication system, the information generated by the one of the sensors to the vehicle determined to be within the set distance from the one of the sensors by the proximity notification system comprising transmitting, from the remote location, the information generated by any of the sensors to the vehicle determined to be within the set distance from that sensor by the proximity notification system using the telecommunications and data network when the vehicle is determined to be within the set distance from that sensor by the proximity notification system.

6. The method of claim 1, wherein the step of determining, using the proximity notification system, when the vehicle is within the set distance from any of the sensors comprises analyzing, using a processor, the current position of the vehicle relative to the fixed position of each of the sensors to determine if a difference between the current position of the vehicle and the fixed position of any of the sensors is less than the set distance.

7. The method of claim 1, wherein the sensors are coupled to a dedicated short range communications network, further comprising transmitting the information generated by the one of the sensors, initiated only when the vehicle is determined to be within the set distance from the one of the sensors, to the vehicle determined to be within the set distance from the one of the sensors by the proximity notification system, using the dedicated short range communications network.

8. The method of claim 1, wherein the information generated by the one of the sensors is directed as a wireless transmission intended for reception by a vehicular navigation system in the vehicle determined to be within the set distance from the one of the sensors by the proximity notification system, whereby operation of the navigation system is changed from the existing operating state to one of the plurality of different operating states as a result of reception of the wireless transmission.

9. The method of claim 1, wherein the step of determining, using the proximity notification system, when the vehicle is within the set distance from any of the sensors comprises using a proximity sensor coupled to each of the sensors that senses the vehicle when the vehicle is within the set distance from the proximity sensor and does not sense the vehicle when the vehicle is beyond the set distance from the proximity sensor.

10. The method of claim 9, wherein the proximity sensor uses a thermal system, a sound sensing system, an optic system, radar or laser radar (lidar) to analyze proximity of the vehicle.

11. The method of claim 9, wherein the proximity sensor comprises a camera or other optical sensor that obtains images, the step of determining, using the proximity notification system, when the vehicle is within the set distance from any of the sensors comprising analyzing images obtained by the camera or other optical sensor to assess a distance between the proximity sensor and the vehicle.

12. The method of claim 1, wherein the step of determining, using the proximity notification system, when the vehicle is within the set distance from any of the sensors comprises:

providing a processor at a location separate and apart from the sensors and the vehicle with the current position of the vehicle and the fixed position of each of the sensors; and determining at the processor, from the provided current position of the vehicle and fixed position of each of the sensors, if a difference between the current position of the vehicle and the fixed position of any of the sensors is less than the set distance.

13. The method of claim 1, wherein each of the sensors is located in a stationary mounting structure in a vicinity of the travel surface and apart from the travel surface.

14. The method of claim 1, wherein each of the sensors is embedded in the travel surface.

15. The method of claim 1, wherein each of the sensors is configured to generate information about travel conditions relating to the travel surface or external objects on or in the vicinity of the travel surface that potentially affect travel of vehicles on the travel surface.

16. The method of claim 1, wherein the property or condition of the travel surface or the environment around the travel surface being measured or detected by the measuring or detecting component in each of the sensors is friction of the travel surface, atmospheric pressure, atmospheric temperature, temperature of the travel surface, moisture content of the travel surface or humidity of the atmosphere.

17. The method of claim 1, wherein the change in operation of at least one of a display, navigation, control and guidance system in the vehicle determined to be within the set distance from the one of the sensors comprises at least one of:

change of movement of the vehicle by the control and guidance system from its course prior to reception of the generated information to a new course dependent on the generated information; and generation by the navigation system of a warning dependent on the generated information.

18. The method of claim 1, further comprising providing energy to each of the sensors from an energy harvesting system included in or connected to the sensor and that generates energy and provides the generated energy to the measuring or detecting component to enable the measuring or detecting component to measure or detect the property or condition of the travel surface or the environment around the travel surface.

19. A method for controlling a display system to provide specific information about driving conditions on a travel surface, comprising:

determining, using a proximity notification system, when a vehicle is within a set distance from any of a plurality of sensors fixed in position relative to a travel surface on which the vehicle is travelling, each of the sensors generating information about the travel surface or an environment around the travel surface and including a measuring or detecting component that measures or detects a property or condition of the travel surface or the environment around the travel surface that affects interaction between tires and the travel surface and which is part of the generated information; and as a result of the determination that the vehicle is within the set distance from any of the plurality of sensors fixed in position relative to the travel surface, directing, using a communication system having a transmitter off of the vehicle and a receiver on the vehicle, the information generated by one of the sensors to the vehicle determined to be within the set distance from the one of the sensors, whereby the information generated by each of the sensors is not directed to the vehicle unless the vehicle is determined to be within the set distance from that sensor by the proximity notification system, whereby in response to the vehicle receiving the generated information being directed to the vehicle, the display system displays a visual indication of content of the generated information on a map shown on a display of the display system such that the visual indication of the content of the generated information is placed on the map as the vehicle approaches the position of the one of the sensors.

20. The method of claim 19, further comprising providing energy to the sensors from an energy harvesting system included in or connected to each of the sensors and that generates energy and provides the generated energy to the measuring or detecting component to enable the measuring or detecting component to measure or detect the property or condition of the travel surface or the environment around the travel surface.

* * * * *